US006581393B2

(12) United States Patent
Newman et al.

(10) Patent No.: US 6,581,393 B2
(45) Date of Patent: Jun. 24, 2003

(54) ICE MAKING SYSTEM, METHOD, AND COMPONENT APPARATUS

(75) Inventors: Todd R. Newman, Traverse City, MI (US); David Shank, Hersey, MI (US); Ronald L. Ballast, McBain, MI (US)

(73) Assignee: Nartron Corporation, Reed City, MI (US)

( * ) Notice: Subject to any disclaimer, the term of this patent is extended or adjusted under 35 U.S.C. 154(b) by 19 days.

(21) Appl. No.: 09/898,208

(22) Filed: Jul. 3, 2001

(65) Prior Publication Data

US 2001/0039804 A1 Nov. 15, 2001

Related U.S. Application Data

(62) Division of application No. 09/617,336, filed on Jul. 17, 2000, now Pat. No. 6,282,909, which is a continuation-in-part of application No. 08/831,678, filed on Apr. 10, 1997, now Pat. No. 6,125,639, which is a continuation of application No. 08/522,848, filed on Sep. 1, 1995, now Pat. No. 5,653,114.

(51) Int. Cl.[7] ..... F25C 1/12
(52) U.S. Cl. ..... 62/135; 62/208
(58) Field of Search ..... 62/74, 158, 182, 62/233, 208, 135

(56) References Cited

U.S. PATENT DOCUMENTS

| | | | | |
|---|---|---|---|---|
| 2,492,970 A | | 1/1950 | Curry | |
| 3,045,445 A | | 7/1962 | MacLeod | |
| 3,046,754 A | | 7/1962 | Kniffin | |
| 3,908,390 A | | 9/1975 | Dickson et al. | |
| 3,946,574 A | | 3/1976 | Portera | |
| 3,964,270 A | | 6/1976 | Dwyer | |
| 4,137,724 A | | 2/1979 | Alexander | |
| 4,238,930 A | | 12/1980 | Hogan et al. | |
| 4,318,278 A | | 3/1982 | Olson et al. | |
| 4,357,808 A | | 11/1982 | Olson et al. | |
| 4,452,049 A | | 6/1984 | Nelson | |
| 4,471,624 A | | 9/1984 | Nelson | |
| 4,510,114 A | | 4/1985 | Nelson | |
| 4,671,077 A | | 6/1987 | Paradis | |
| 4,731,548 A | | 3/1988 | Ingraham | |
| 4,758,735 A | | 7/1988 | Ingraham | |
| 4,785,641 A | | 11/1988 | McDougal | |
| 4,827,732 A | | 5/1989 | Suyama et al. | |
| 4,831,279 A | | 5/1989 | Ingraham | |
| 4,884,413 A | * | 12/1989 | Quandt et al. | 62/135 |
| 4,938,030 A | | 7/1990 | Josten et al. | |
| 4,959,966 A | | 10/1990 | Dimijian | |
| 5,027,610 A | * | 7/1991 | Hara | 62/135 |
| 5,087,825 A | | 2/1992 | Ingraham | |
| 5,142,878 A | | 9/1992 | Hida et al. | |
| 5,291,747 A | | 3/1994 | Sakai et al. | |
| 5,442,435 A | | 8/1995 | Cooper et al. | |
| 5,582,018 A | | 12/1996 | Black et al. | |
| 5,653,114 A | | 8/1997 | Newman et al. | |
| 5,706,660 A | | 1/1998 | Shank et al. | |
| 5,796,183 A | | 8/1998 | Hourmand | |
| 5,828,458 A | | 10/1998 | Taylor et al. | |
| 5,901,561 A | | 5/1999 | Allison et al. | |
| 5,922,030 A | | 7/1999 | Shank et al. | |
| 5,950,439 A | | 9/1999 | Peterson et al. | |

* cited by examiner

*Primary Examiner*—William E. Tapolcai
(74) *Attorney, Agent, or Firm*—Brooks & Kushman P.C.

(57) ABSTRACT

An ice making machine controller system includes methods and components for making commercial quantities of ice pieces includes adaptive controls responsive to input sensors, output actuators, adaptive ice making control algorithms, adaptive ice harvesting control algorithms, diagnostics for operation cycle monitoring and communicating, and reprogrammable, expanded controller memory for reliable and efficient operation under diverse conditions.

33 Claims, 12 Drawing Sheets

10
33
17
18
PUMP
12
11
13
WATER SUPPLY
16
22
48
CONTROLLER
47
46
24
26
14
15
19
40a
42
44
36
21
49
50
34
40b
38
45
30
51
52
COLD REFRIGERANT SUPPLY
HOT REFRIGERANT SUPPLY
32
28
41

ICE MAKING SYSTEM, METHOD, AND COMPONENT APPARATUS

This is a divisional of application(s) Ser. No. 09/617,336 filed on Jul. 17, 2000; now U.S. Pat. No. 6,282,909.

This patent application is a continuation-in-part of Ser. No. 08/831,678 filed Apr. 10, 1997 now U.S. Pat. No. 6,125,639, Method And System For Electronically Controlling The Location Of The Formation Of Ice Within A Closed Loop Water Circulating Unit which is a continuation of prior application Ser. No. 08/522,848 filed Sep. 1, 1995 Method And System For Electronically Controlling The Location Of The Formation Of Ice Within A Closed Loop Water Circulating Unit, now U.S. Pat. No. 5,653,114, (incorporated by reference in their entirety).

FIELD OF THE INVENTION

The present invention relates to ice making methods and apparatus that have adaptive controls for addressing diverse operating and ambient conditions.

BACKGROUND ART

Commercial experience has revealed that productive ice-making systems and functional components may not adapt to diverse ambient conditions or internal operating conditions. One particular type of commercial ice making machine sensing system involves optoelectronic IR (infrared) emitters and detectors used to detect beam blockage in several sensing applications. An optoelectronic IR beam blockage sensor apparatus may detect falling ice pieces during the ice harvesting operation, a level of ice in the ice storage bin representative of a bin full condition, and low or high levels of water in the ice-making sump reservoir to provide signals respectively used with automatic ice making.

Basic optoelectronic sensing techniques have inherent detriments that impede consistent, reliable, and long-term operation. Optoelectronic emitters and detectors are prone to changes in characteristics as a function of changes in operating voltages, currents, and temperature. Optoelectronic emitters are particularly susceptible to detrimental and permanent changes in emission efficiency with age based upon accumulated operation time under conditions of elevated semiconductor junction temperature and high operating voltage or current.

Prior optoelectronic sensor implementations suffer performance degradations due to relatively slowly changing conditions and parameters including operating temperature, component age, degradation of the emitters, misalignment of optical components, mineral haze accumulation on optical lenses, moisture condensation on optical lenses, fog, ambient levels of IR radiation, and the like. The practical result has been the sensor subsystem causing the ice making system to go into a diagnostic fault and shutdown mode that interferes with ice making operation, often due to dirty lenses, and an error indication merely communicates the need for service.

Previous methods of optoelectronic sensing using DC optocoupling and a fixed DC comparator require high emitter drive and high detector gain to sense falling ice under poor optocoupling conditions. This causes a detrimental condition whereby ambient sunlight potentially "blinds" the optodetector due to output saturation, thus losing the capability to detect relatively small changes in signal level that occur when a slight dynamic optocoupling reduction is caused by a falling ice piece, and reduces capability to distinguish such an event from other ambient conditions and changes in ambient conditions. Detector blinding due to output saturation is cause for the ice making system to go into shutdown to protect itself from potential damage.

False sensing of ice via a previous optoelectronic method was possible because sensing methods implemented quick controller microprocessor interrupts set by a single false detection of an ice obstruction. Electrical noise had the potential to set the interrupt flag, thus causing a false sensing of the presence of ice and the microcontroller algorithm required approximately 200 lines of code and reacted relatively slowly.

A previous problematic optoelectronic sensing system operated pulsed drive of the optoemitter drive circuitry at 120 Hz which is inherently the same frequently as many discharge lamp pulses, electromagnetic fields, and electrical noise producers operating from a 60 Hz power source. Frequency spectra of noise and signal thus have common harmonics that preclude simplified methods to filter out the shared 120 Hz noise fundamental and odd harmonics thereof.

Ice machine methods, systems, and apparatus provide numerous control algorithms for both ice seeding and for harvesting operations. To address significant numbers and ranges of types and sizes of ice, and numerous possible ambient operation conditions for ice-making machines, a proliferation of control algorithms with specific programmed operation parameters would be required in previously known systems, thus resulting in excessive machine service.

Additionally, previous fault diagnostics response algorithms have caused ice-making machines to go into a fault response shutdown condition calling for service due to temporary faults. Such temporary faults are caused by such actions as leaving the ice machine door open so that IR optoelectronic detectors are saturated with ambient IR radiation and temporary loss of supply water pressure. In either of these two unanticipated conditions, the default timeout fault response has been to shutdown operation and indicate need for a service call.

Interrelated complexity of ice machine system operation components including sensors, compressor, heat exchangers, ambient conditions, supply water temperature, supply water quality, and the like typically result in less than optimal performance. Previous ice machine operation system, methods, and components typically result in tradeoffs to favor machine safety versus ice production performance. Furthermore, ice machine controller system hardware has been somewhat distributed and separate, each additional feature causing additional hardware and assembly costs due to increased interface wiring, electrical connectors, multiple independent modular assemblies for control, and the like.

SUMMARY OF THE INVENTION

The present invention overcomes the above-mentioned disadvantages by providing a method and apparatus for increasing ice machine production capability and reliability by enabling a set of cooperating improvements with adaptive controls to an ice production system. In general, system reliability, performance, and cost improvements are enabled by enhancements such as selection of a microcontroller incorporating flash ROM (read only memory) enabling end-configuration programmability. In addition, selection of a microcontroller containing integral EEPROM memory enables greater adaptive algorithm control and operation parameter modification, reprogrammability, and lower controller cost. Furthermore, an improved communication interface capability and an expanded fault diagnostic data storage may provide for simplified service. The system preferably includes operation history monitoring for performance validation. Integrated control assemblies improve control and lower cost, while the adaptive electronic circuits control optoelectronic sensing components. Additional output drive and associated controls hardware control compressor starting, compressor operation, reduction of compressor output pressure, and heat exchanger blower fan speed. Sensors provide inputs in response to detected conditions including water reservoir high level, water reservoir low level, ice thickness, supply line voltage, ice door closed, and compressor output pressure.

Preferably, the apparatus component improvements that enable system improvements and method improvements preferably include: adaptive optoelectronic emitter and/or detector circuitry, preferably for sensing falling ice pieces during harvest operation and sensing the ice bin full status. Preferably, both such functions are performed by a single set of emitter and detector components, although each set may have multiple emitters and detectors. In addition, optoelectronic sensing of reservoir high and low water levels preferably utilize programmed and adaptive software thresholds based upon sampling and averaging. Furthermore, an alternative modification may be to utilize acoustic and/or vibration sensing of falling ice pieces during harvest operation and standing ice present in the ice chute. In another embodiment, ice mold types harvest ice as one large piece that breaks up when it drops, and a water splash curtain swings aside from the dropping of harvested ice. Preferably a simple and low cost magnet and reed switch sensor system for curtain position indicates the ice harvest.

A capacitive electric-field dielectric proximity sensor for ice thickness senses ice proximity to determine an end of cycle based upon a thickness and amount of ice. Ice making is alternatively determined by contact with vibrating probes such that the vibration frequency lowers as ice growth encompasses said probes. An ice door switch preferably signals a closed status of the ice removal door, and AC line voltage monitoring circuitry may respond to a condition such as voltage or current outside a preferred range, for example, ±10% of nominal voltage, for protective shutdown of the system, the compressor and other loads.

A programmable and adaptive water quality sensor, based preferably upon at least one principle including optoelectronic turbidity, electroconductivity, and/or dielectric property determines the need for purging the water reservoir of undissolved and/or dissolved minerals. This provides an adaptive purge cycle that may purge more or less often than per each default, where each default may be a predetermined number of cycles and/or an ice making duration time since the last purge cycle.

Preferably, communication hardware for simplified service interface inputs, outputs, and controller reprogramming may be provided.

For reduced compressor outlet pressure during compressor motor startup to ease starting current transients and increase compressor motor control relay contact life, the controller 70 controls pressure relief in response to motor start up command. For example, the controller's response may be actuating one of a plurality of valves where each of the molds in a plurality of molds includes an evaporator valve, or actuating a dedicated bypass valve. For improved performance and/or component life of the ice machine compressor motor, associated power switching components, and/or other devices sharing the power line, compressor unloading is the preferred means of system improvement. Such technology is commonly owned and fully described in U.S. Pat. No. 5,950,439 Methods and Systems For Controlling a Refrigeration System. Preferably, a solid state relay actively controls a compressor motor starting coil—preferably with controlled ON-switching at peak line voltage to reduce peak starting currents into the inductive load. Preferably, a positive temperature coefficient (PTC) resistor is installed in series with compressor motor start coil to protectively limit motor heating associated with repetitive starting and/or excessive starting time.

Incorporation of a dump valve module part of ice machine into an ice machine controller module improves the system for smaller size, better control, and lower cost. Preferably, solid state drive circuitry enables switched speed drive control of compressor and/or fan motor loads for enhanced operation performance. Examples of variability provided by this control include efficiency of operation, highest ice production, quiet operation, clearest ice production, etc. For updating program algorithms, a portable smart card memory may be utilized by a service technician. For example, a 4 Mbyte EEPROM versus typical 8 Kbyte ROM in microcontroller memory—enables field upgradable reprogramming based upon fault diagnostics, operation performance history, ice machine type, and/or ice machine environmental conditions for improved fault detection and response, improved operation history data storage, and improved fault response such as repeated and extended retry versus system shutdown. Increased controller capability may be provided by enhanced microcontroller memory size, EEPROM memory, and the communication interface for polling of memory and for reprogramming.

Method improvements enabled by intelligent adaptive utilization of said improved system capability result in net productivity and reliability gains. A programmable time duration delay occurs after compressor turn-on to allow prechilling of the evaporator plate/ice making molds, after which time duration water circulation is started—for more reliable ice seeding and for more controlled water cooling conditions for monitoring of reservoir water temperature cooling rates as discussed below. A programmable number of refilling water reservoir steps occur during a complete ice making cycle based upon system hardware configuration of reservoir size, type of ice molds, and number of ice molds. A programmable and adaptive reservoir water temperature is set, at which temperature an ice seeding operation occurs. A programmable reservoir water temperature is set, below which temperature warmer makeup water is added to the reservoir to avoid ice slush formation. A programmable reservoir water temperature cooling rate is set, above which rate warmer makeup water is added to the reservoir to avoid ice slush formation.

A programmable and adaptive time duration is set for which the water reservoir level goes from high to low, above which duration an extended duration harvest cycle is performed. A programmable and adaptive time duration is set to sense a last falling ice piece during harvest cycle, above which time duration an extended harvest cycle is performed. An over/under dual ice machine configuration shares a harvest sensor whereby both ice machines stop production based upon a bin full condition.

A side-by-side ice dual ice machine configuration shares a cycle timing control whereby both ice machines coordinate ice making cycles to the cycle time of the slower ice production speed—for the purpose of precluding customer service complaints about dissimilar production rates. Preferably, a programmable and adaptive time duration is set for water circulation discontinuation during ice seed operation. Preferably, use of purge valve vs. reliance upon an overflow stand pipe for water purge operation more aggressively expels reservoir water containing contaminants. Preferably, fault detection history data are stored for moving time windows immediately before and during soft and hard fault conditions to augment service troubleshooting. Preferably, operation performance history data and statistics are stored in system memory for performance evaluation and study pursuant to developing system hardware and/or software improvements.

BRIEF DESCRIPTION OF DRAWINGS

The present invention will be better understood by reference to the following detailed description of a preferred embodiment when read in conjunction with the accompanying drawing, in which like reference characters refer to like parts throughout the views, and in which.

DETAILED DESCRIPTION OF A PREFERRED EMBODIMENT OF THE INVENTION

Figure 1:
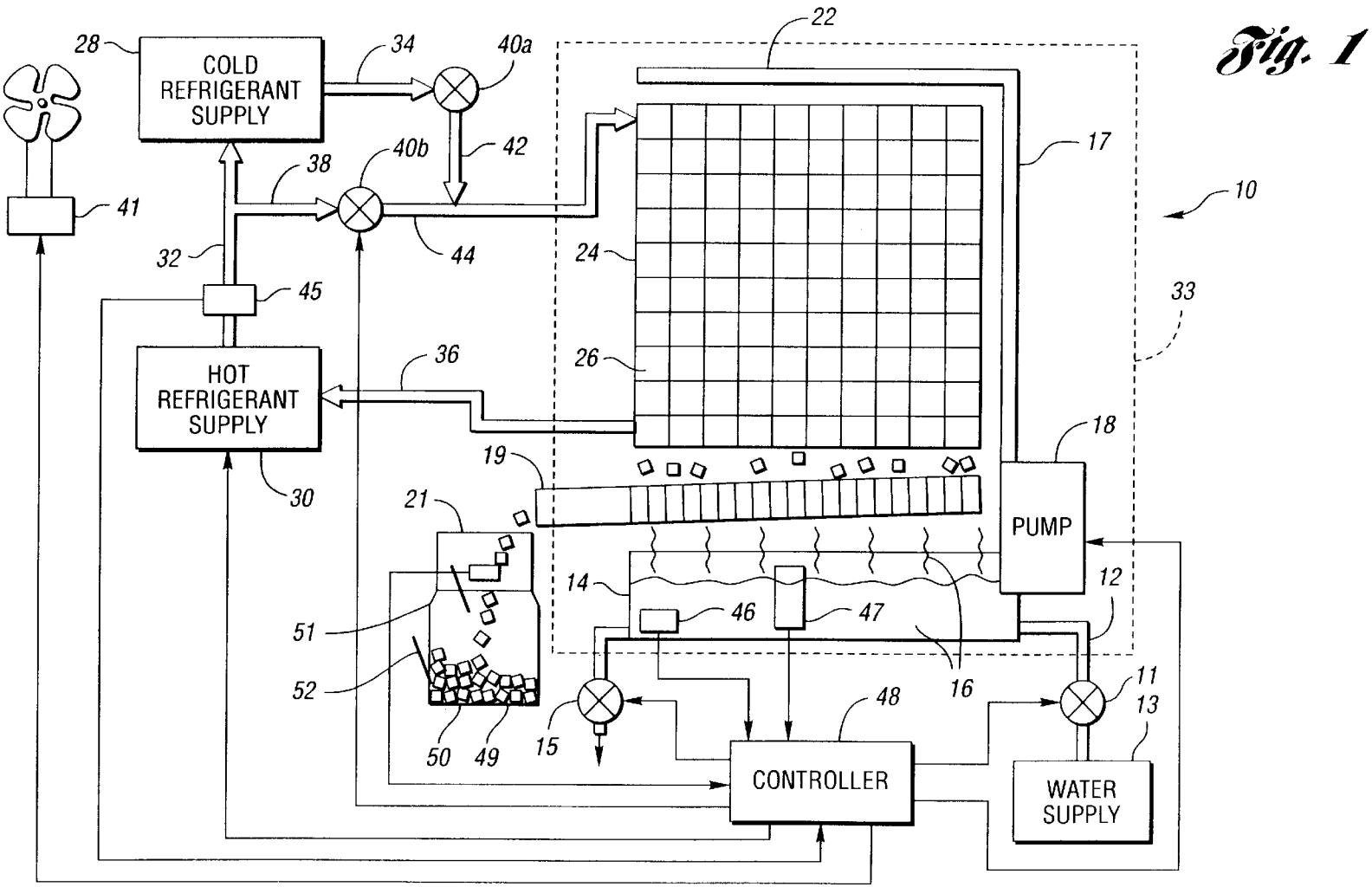
FIG. 1 is a systematic diagram of an ice making system for the apparatus and methods of the present invention.

Turning now to FIG. 1, there is shown a schematic diagram of the ice-making system of the preferred embodiment of the present invention, denoted generally by reference numeral 10. The system 10 includes a water inlet line 12 for receiving water from a water supply 13. A valve 11 is provided in fluid communication between the water inlet line 12 and the water supply 13. The valve 11 controls the flow of water from the water supply 13 to the water inlet line 12.

The water inlet line 12 transfers the water 16 to a reservoir 14. When sufficient water is supplied to the reservoir 14, the water inlet line 12 is shut off and a pump 18 pumps the water 16 from the reservoir 14 into a manifold 22. The manifold 22 has holes (not shown) that allow the water 16 to flow down and across an ice mold 24. The flowing water 16 passes across the surfaces of individual ice mold cavities 26 of the ice mold 24.

The system 10 of the present invention also includes a cold refrigerant supply 28 acting as a condenser and a hot refrigerant supply 30 acting as a compressor. The cold refrigerant supply 28 includes an inlet line 32 from the hot refrigerant supply 30 and an outlet line 34. The hot refrigerant supply 30 includes an inlet line 36 from the ice mold 24 and the cold refrigerant inlet line 32 to the cold refrigerant supply 28. A hot refrigerant supplemental outlet line 38 is also provided. A first valve 40*a* couples the cold refrigerant supply 28 to the ice mold 24 via a first mold inlet 42. Similarly, a second valve 40*b* couples the hot refrigerant supply 30 to the ice mold 24 via a second mold inlet line 44. The first valve 40*a* and the second valve 40*b* may be replaced by a single double-acting valve (not shown).

When the system 10 is turned on, cold refrigerant from the cold refrigerant supply 28 is supplied to the ice mold 24 via the first valve 40*a*. The second valve 40*b* is closed. Cold refrigerant vapor or cold mixed phase refrigerant (liquid+vapor) is passed through the cold refrigerant outlet line 34 and the first mold inlet line 42. This allows the ice mold 24 to function as an evaporator. The evaporated refrigerant is then routed back to the hot refrigerant supply 30 through the hot refrigerant inlet line 36.

The first valve 40*a* also functions as an expansion device to lower the temperature of the refrigerant before it reaches the ice mold 24. When the first valve 40*a* routes the cold refrigerant through the ice mold 24, the ice mold cavities 26 are rapidly cooled along with the water 16 that flows across the ice mold cavities 26. The cooled water 16 eventually flows back to the reservoir 14 and is eventually circulated back to the manifold 22 through the pump 18. As the water 16 is circulated through the system 10, the temperature of the water throughout the system 10 is steadily diminished. Once ice formation is complete, the harvesting of the ice is initiated by closing the first valve 40*a* and opening the second valve 40*b*. This has the effect of forcing the ice mold 24 to act as a condenser while removing the evaporator function from the system.

The initially ice-free surfaces of the ice mold cavities 26 and the continually moving water 16 in the system 10 combine to allow a supercooling condition to occur in the water. In existing systems, this supercooling of the water 16 can easily reach a temperature of 24° F. Slush forms throughout the system when supercooling reaches a system, pressure and water impurity-dependent lower limit, e.g., 24° F. in some systems. Once the temperature of the water 16 in the reservoir 14 falls below the lower temperature limit, natural vibrations in the system 10 may cause freezing to begin. Typically, this starts at the nozzles in the manifold 22. Once the freezing is initiated, the water 16 may be converted to slush throughout the system 10 and flow through the nozzles of the manifold 22 and/or the pump 18 stops or slows. This slush problem can be circumvented if ice formation can be initiated on the ice mold 24 before an unstable level of supercooling is reached. Once ice formation is initiated on the ice mold 24, the heat of fusion given up by the ice prevents the unfrozen water flowing across the ice mold 24 from retaining any significant degree of supercooling since water in contact with ice tends to maintain an equilibrium temperature of 32° F.

The system 10 of the present invention utilizes a temperature sensor 46 to monitor the temperature of the flowing water. Preferably, the sensor 46 is located in the reservoir 14. An uninsulated reservoir 14 might never reach a supercooled condition since it absorbs heat from ambient air. This would eliminate or minimize supercooling, but would waste cooling capacity.

Coupled between the sensor 46 and the pump 18 is a controller 48. When an ideal degree of supercooling has been reached, the controller 48 shuts off the pump 18. The water flowing across the ice mold 24 then runs off the ice mold 24 leaving behind a few droplets. Without the warming action of the flowing water, the ice mold cavities 26, being part of the evaporator, rapidly drop in temperature and thereby create an extreme degree of supercooling in the stationary water droplets left behind. The stationary water droplets then rapidly freeze.

The controller 48 reactivates the pump 18 after a short period of time, such as a few seconds. When the pump 18 is turned back on, the flow of water across the ice mold 24 resumes. However, the frozen droplets in contact with the supercooled water form crystal "seeds" upon which the flowing water freezes. Rather than convert to 32° F. slush, the supercooled flowing water converts to 32° F. liquid water as it freezes onto the ice seeds and liberates the "heat of fusion" of the water. The 32° F. water returning to the reservoir 14 rapidly raises the temperature of the water in the reservoir 14 to 32° F.

Seeding can be verified by monitoring the rate at which the temperature of the water in the reservoir 14 rises. If temperature sensor 46 fails to detect a temperature rise to 32° F. in the reservoir 14 after an appropriate time interval, e.g., 10 seconds, the controller 48 momentarily shuts off the pump 18 to re-initiate the seeding process. This pump stopping and temperature measurement process continues to cycle until a successful seeding has been detected after which point the pump 18 remains on. Upon accomplishing the seeding process, the supercooling is removed from the system 10 and ice formation takes place at the desired location, i.e., the ice mold 24.

Alternatively, it may be desirable to initiate ice seeding at a temperature above freezing. If seeding is initiated at too high a temperature, however, the flowing water would melt the ice seed once the pump is reinitiated. Ice seeding can be verified by monitoring the temperature of the reservoir. For example, if ice seeding is initiated at a water temperature of 36° F., the temperature of the water would be expected to slowly drop to 32° F. If the temperature dropped below 32° F., however, this is an indication that seeding has failed.

When sufficient time has passed after the seeding process, the ice mold 24 is filled with ice. The controller 48 shuts off the pump 18. The valve 40*a* closes to disconnect the cold refrigerant outlet line 34 from the mold inlet lines 42 and 44. The valve 40*b* then opens to connect the hot refrigerant supplemental outlet line 38 to the mold inlet line 44. The hot refrigerant vapor rapidly raises the temperature of the ice mold 24 above 32° F. This in turn melts the ice immediately in contact with the surfaces of the ice mold cavities 26. Once the surface ice is melted, the ice cubes rapidly release from the ice mold cavities 26 and fall into a collection bin 51. The water inlet valve 11 is then opened to refill the reservoir 14 from the water supply 13 and the process is repeated as required.

Referring now to FIG. 2, a preferred optoelectronic detection system 60 incorporates a number of features including duty cycle operation of both the optoemitter 62 and optodetector 64. In addition, the preferred embodiment uses one emitter circuit and one optodetector circuit that serves as both the harvest sensing detection element and also as a sensor for cube storage capacity. Preferably, the sensor pulses at 500 Hz, which is well above primary frequencies of noise including DC, 60 Hz, and 120 Hz. A closed loop feedback control of the optoemitter drive currents is based upon and maintains the sensed AC magnitude of the optodetector AC signal. An optocoupling feedback control loop demonstrates a significant improvement toward ideally closing the entire optoelectronic loop, not by other optoelectronic reference correlation, but by a true closed loop control system. The microprocessor controls the electronic sensing system and microprocessor monitoring of the drive levels of the optoemitter provides at least one operator notification signal in the event of such drive levels being above or below normal levels. Filters on the optodetector reduce the effects of ambient light on the preferred infrared system. As a result, the invention can enable a very wide diversity of optoemitter and optodetector sensing systems, whether analog or digital based.

The adaptive optoelectronic system provides numerous practical benefits including improved performance in heavy fog conditions, and improved performance in bright sunlight conditions operation despite increased levels of mineral haze fouling of optics or thus increasing time between required service to clean optics. These improvements enable practical mixing of high and low performance optoelectronic emitters and detectors, and eliminates selection and sorting for performance grades of the components installed. Improvement in signal-to-noise levels enables operation despite significant noise sources or moisture condensation on lenses.

An improved IR optoelectronic sensing system senses beam blockage, preferably between at least one lensed IRED and at least one lensed IR detector, for each condition sensed but multiple sensors and detectors can be used for numerous and varied sensing applications including falling ice, ice bin full level, full water reservoir level, and low water reservoir level. Use of two or more emitters in series to one sensed input circuit provides a logical OR sensing of blockage of optocoupling to any of the multiple detectors in series. Emitter and detector lenses both increase the power density of the optocoupling from the emitter to the detector. One preferred sensing system operation mode utilizes at least one IRED and at least one IR detector in pulse mode operation with closed loop feedback control of emitter and/or detector circuitry to regulate the detector AC signal amplitude and thus compensate for potentially wide variations of detector output signal amplitude. Low ON TIME duty cycle pulsing of the optoemitter, typically in the range of 2% to 50%, enables increased drive power for improved signal-to-noise of the optocoupling while still maintaining a relatively low average optoemitter drive power for longer reliable life.

The preferred method differs from prior art in that it closes the feedback control loop with the emitter and detector components intrinsically compensating for all opto and electronic variables in the loop. Electronic closed loop feedback response enables sensing of slight optocoupling amplitude variations, for example, on the order of approximately 20% that would be characteristic of the response produced by an ice piece dropping between the emitter and detector, as well as sensing within the relatively short time of the beam interference by such a falling ice piece. Furthermore, the relatively slower time loop response of the electronic servo circuit can also sense a high fraction of IR beam blockage that would be characteristic of a pile of ice when the ice bin is full. Inclusion of mutually-aligned polarized filters on all cooperating optoemitter and optodetector components reduces detector sensing of randomly polarized IR radiation from steady ambient sources, noise sources, and from altered angles of polarization caused by refraction and reflection from target ice pieces.

Optoemitters and optodetectors are preferred to exhibit matching spectral properties that avoid peak emission frequencies from sunlight and artificial lighting sources. Silicon-based near-IR emitters and detectors exhibiting matched spectral properties are readily available for this purpose. Alternative optoemitter and optodetector component choices having only partial spectral overlap are improved in optocoupling system performance by use of spectral filter material at the optodetector for the purpose of more closely matching the net optodetector spectral response with that of the optoemitter.

Additionally, the optoelectronic sensing control system monitors the feedback-controlled level of current drive necessary to maintain the sensed AC signal magnitude and when such drive current falls outside of predetermined operating limits, an indicator signal is communicated to perform preventative maintenance of cleaning the optics.

False sensing of ice by previous optoelectronic sensing methods has been eliminated by use of improved hardware and/or software filtering. Greatly improved sensing operation stability results due to the feedback verification necessary to ascertain that despite stepwise increases to a threshold of the optoemitter drive current, controlled by the feedback circuit and switch-controlled by the microcontroller, the optodetector signal still has a low signal magnitude. Further sensing speed benefit is realized by new microcontroller code utilizing only about 50 lines of programming code versus the previous interrupt method of approximately 200 lines.

Furthermore, the improved optoelectronic system implements pulsed operation at a frequency of typically 500 Hz or higher that enables hardware and/or software bandpass filters to significantly eliminate 60 Hz and 120 Hz interference noise sources from detrimentally affecting sensed signals.

Figure 2A:
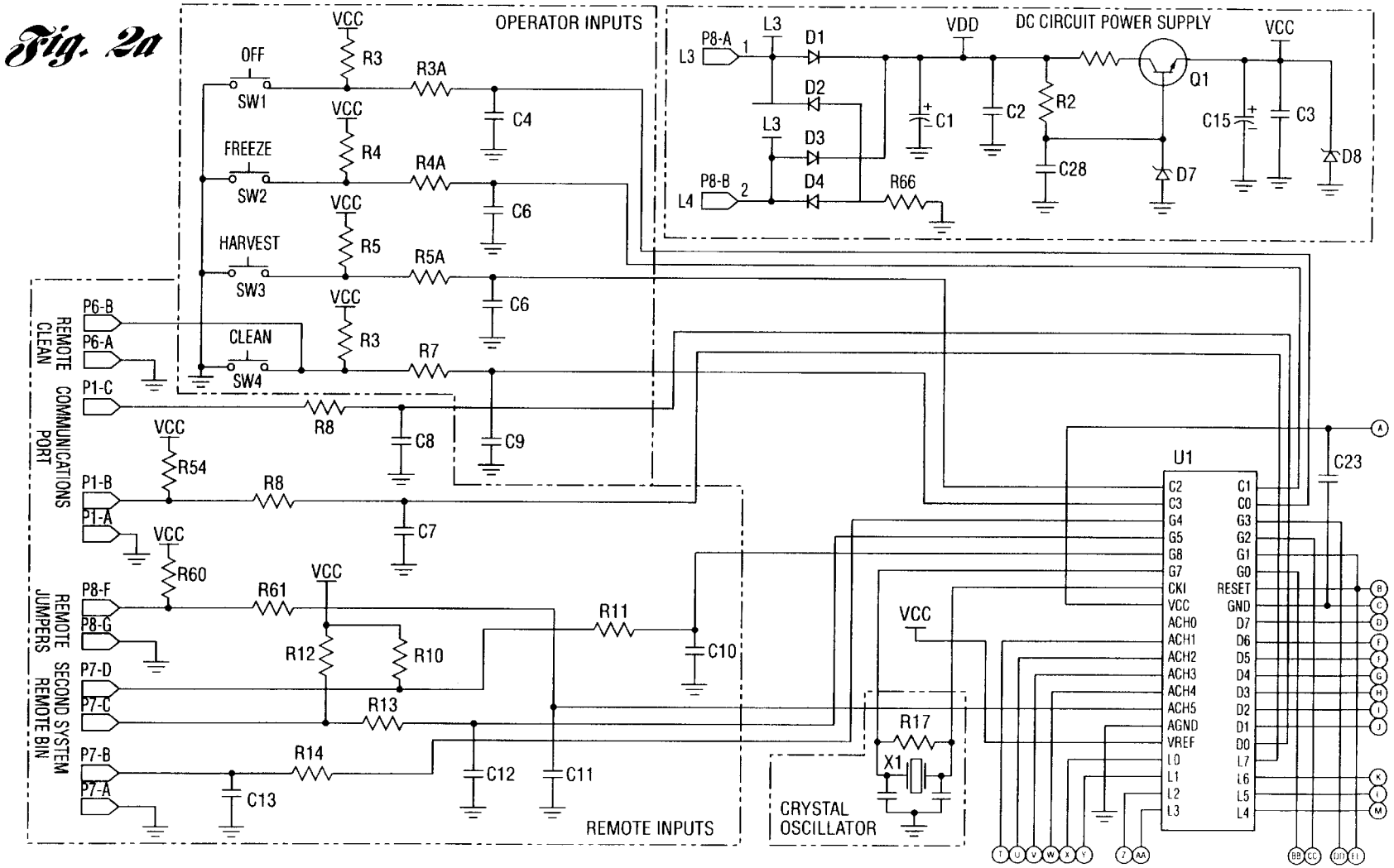
FIG. 2 is an electronic circuit schematic diagram intended to represent one preferred commercial means of implementing optoelectronic sensing of ice pieces for a control in FIG. 1.
Figure 2B:
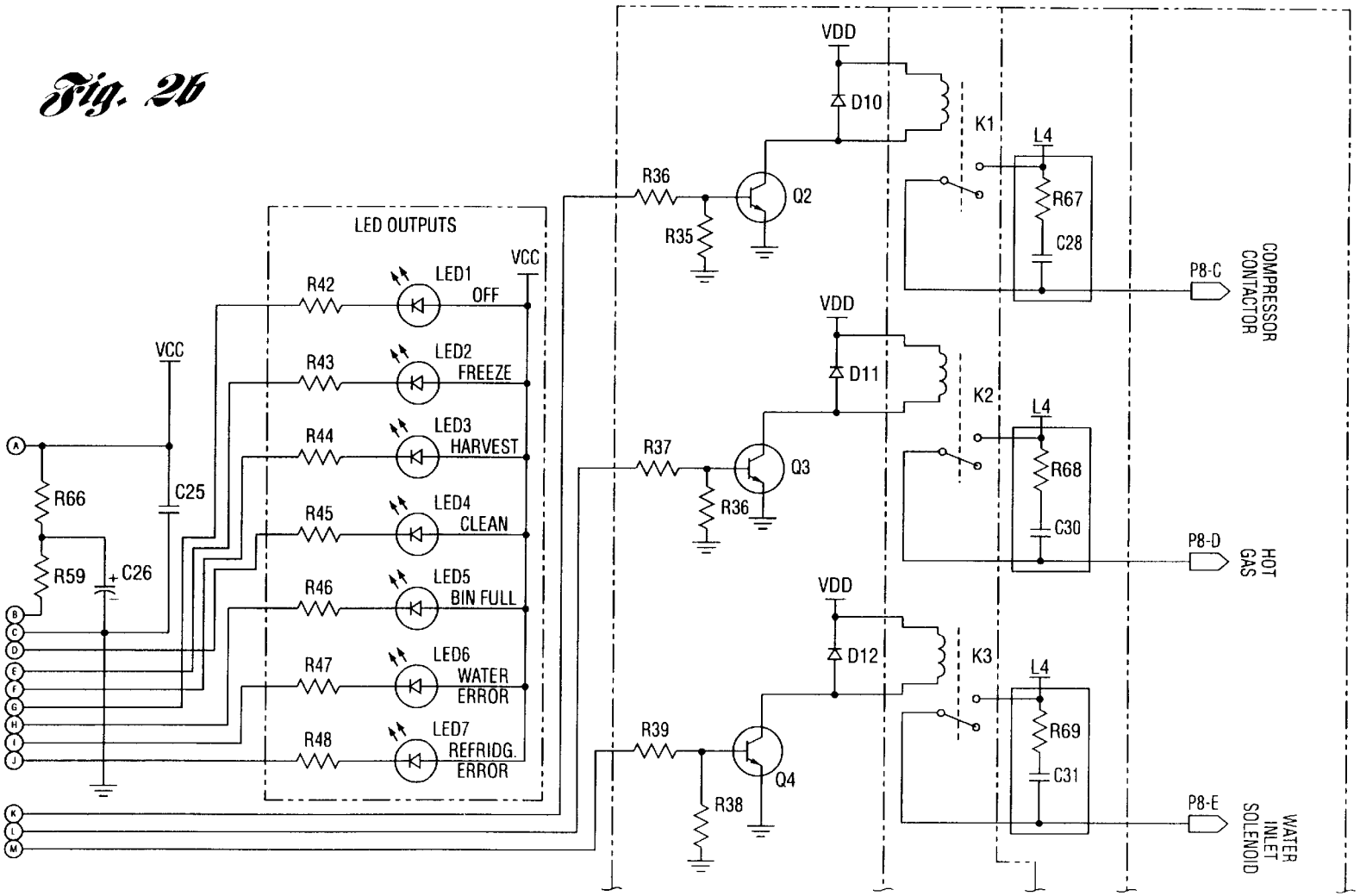
Figure 2C:
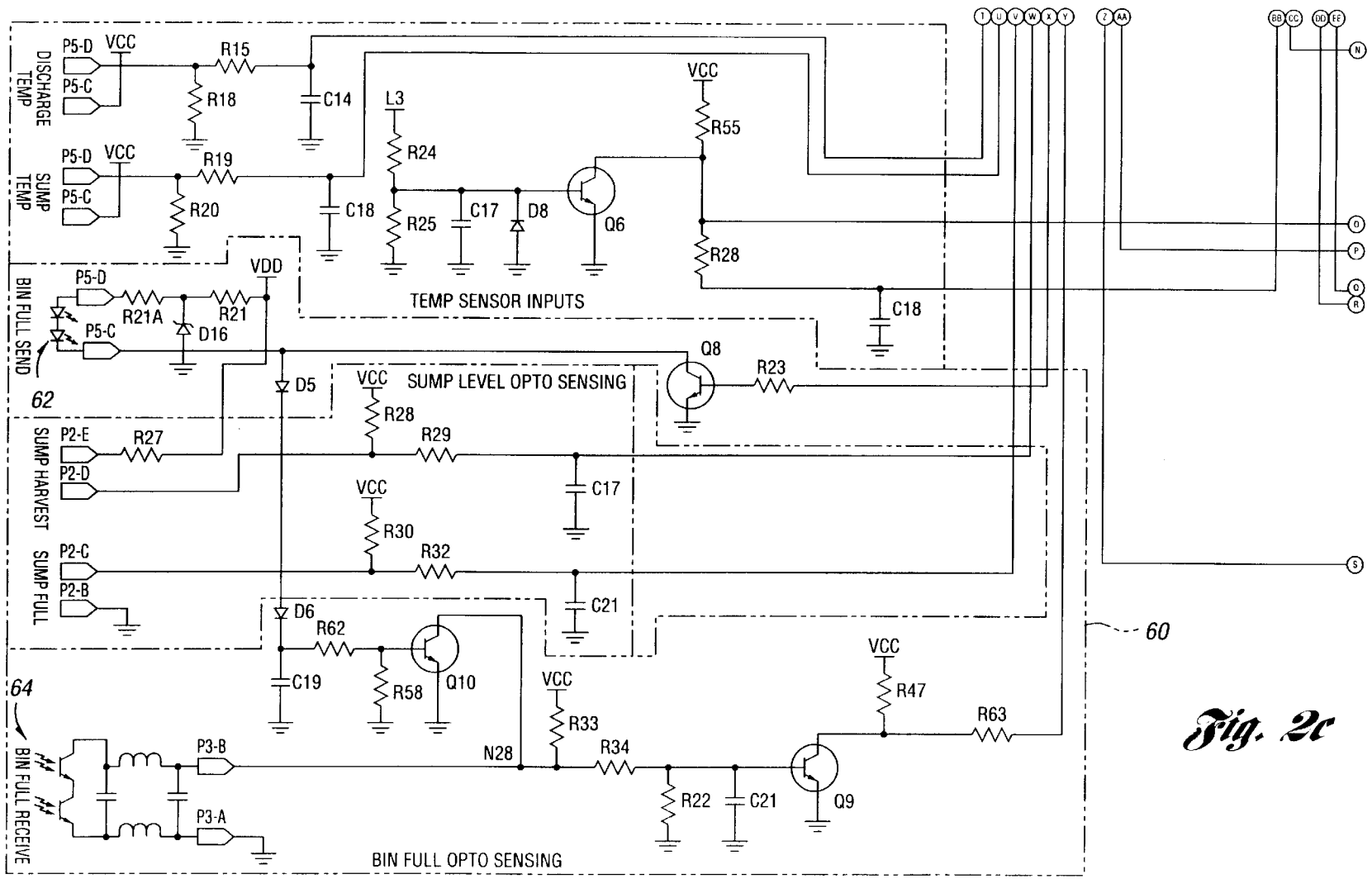
Figure 2B:
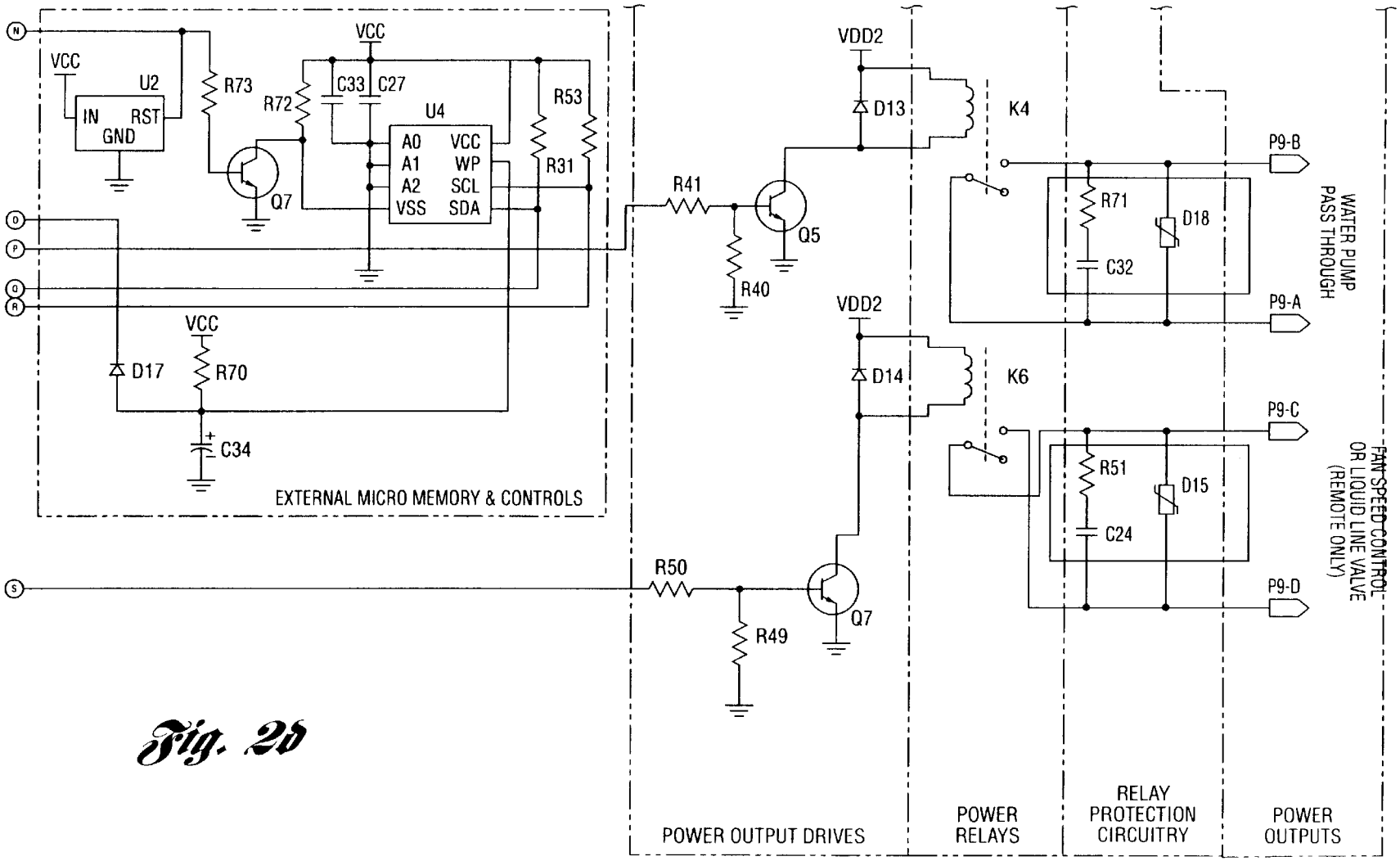

FIG. 2*c* reveals one particular simplified implementation 60 of an improved optoelectronic means for sensing ice pieces. This version drives two emitters 62 in series with digital pulsing signals via microprocessor control. During emitter ON times the basic circuit is 5.1 volt supply at D16 through 100 Ohm resistor R21A through two IREDs (infrared emitting diodes) through NPN transistor Q8 to ground, transistor Q8 switched by microprocessor digital output signals from output terminal L0. The collector of NPN switching transistor Q8 is connected via two series voltage dropping diodes D5 and D6 and resistor R62 to the base of NPN transistor Q10 with its collector connected to a pulled up sensing node N28 as well as to the collector of one of two series IR phototransistors 64 to ground. Sensing node N28 is further connected to the base of NPN transistor Q9 that has its collector pulled up and connected to a digital input terminal L1 of the microprocessor. The two IREDs 62 and two IR phototransistor detectors 64 are physically aligned to couple IR from the emitters to the detectors. This arrangement implements no compensation for temperature, component aging, misalignment of optical components, degradation of the emitters, mineral deposits on optics, moisture condensation on optics, fog between emitters and detectors, or ambient IR radiation. Emitter drive and detector gain are set relatively high to provide satisfactory performance.

The interrelated circuitry of the two series diodes between emitter and detector circuitry provides synchronized operation that fails safe by ostensibly "seeing" ice. When emitter drive transistor Q8 is turned off, sufficient current still passes through the two IREDs 62 and through the two series diodes to the base of NPN transistor Q10 to turn it fully on to pull down sensing node N28 thus turning off NPN transistor Q9 thus allowing pullup resistor R33 to pull up digital input L1 of the microcontroller. When emitter drive transistor Q8 is turned on sensing node N28 will be pulled high by pullup resistor R33 unless both of the series IR detectors 64 are turned on by "seeing" IR, in which case NPN transistor Q9 will be turned off so pullup resistor R47 will pull up digital input L1 of the microcontroller. In the event of failure of any of the emitters or detectors or blockage of IR coupling between emitters 62 and detectors 64, microcontroller input L1 will see a logical low.

An alternate preferred circuit for improved optoelectronic sensing means is shown in FIGS. 3*a*–3*d*. Both the IRED anode and the IR sensor collector are powered from +12V via respective resistors. The IRED drive and the IR sensor signal are interactive in a closed loop feedback circuit implemented via hardware and software to slowly vary emitter drive to provide a sufficient sensor signal to compensate for relatively slowly changing variables including temperature, component age, degradation of the emitters, mineral deposits on optics, moisture condensation on optics, fog between emitters and detectors, or ambient IR radiation.

Figure 4:
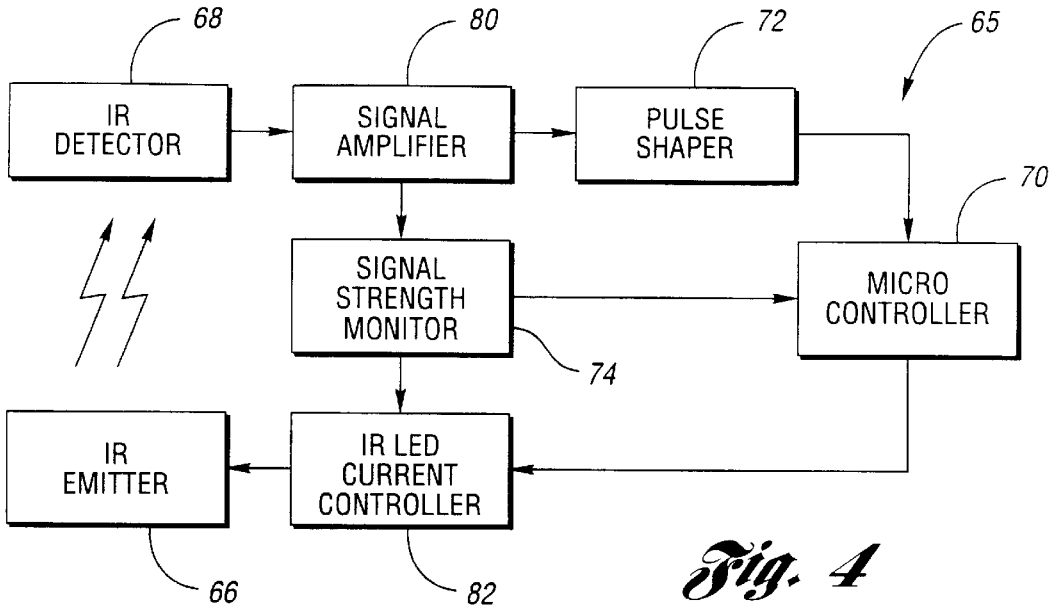
FIG. 4 shows a simplified block diagram of an adaptive closed loop feedback control of a typical preferred optoelectronic control circuit.

FIG. 4 shows a simplified block diagram of an adaptive closed loop feedback control 65 of a typical preferred optoelectronic control circuit. The IR signal is received by the IR detector 68 and amplified by the signal amplifier 80. This signal is then sent to the pulse shaper 72 and signal strength monitor 74. The pulse shaper 72 changes the received information into a format readable by the microcontroller 70. The signal strength monitor sends out a correction signal to the IRED current controller 82 that in turn adjusts the current level to the IR emitter 66 in order to maintain a constant received signal strength. This current supply is pulsed by the microcontroller to send out the correct IR pulse train. In addition, the signal strength monitor sends the microcontroller a voltage that indicates how good or bad the received signal is. Using this information, the microcontroller can generate or initiate an alert to an operator when the IR lenses need to be cleaned.

Figure 5:
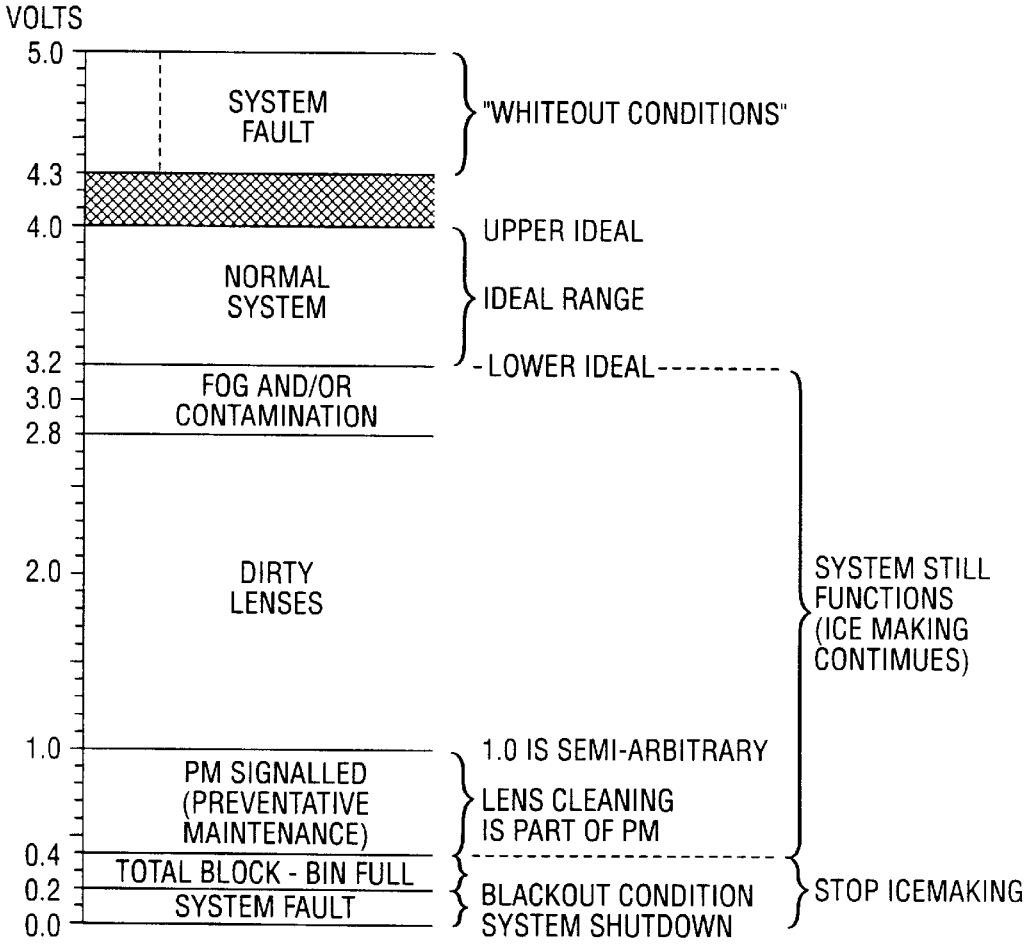
FIG. 5 shows the input voltage to the microcontroller of FIG. 4 that enables it to determine the condition of the optical coupling between the IR emitter and the IR detector.
Figure 6:
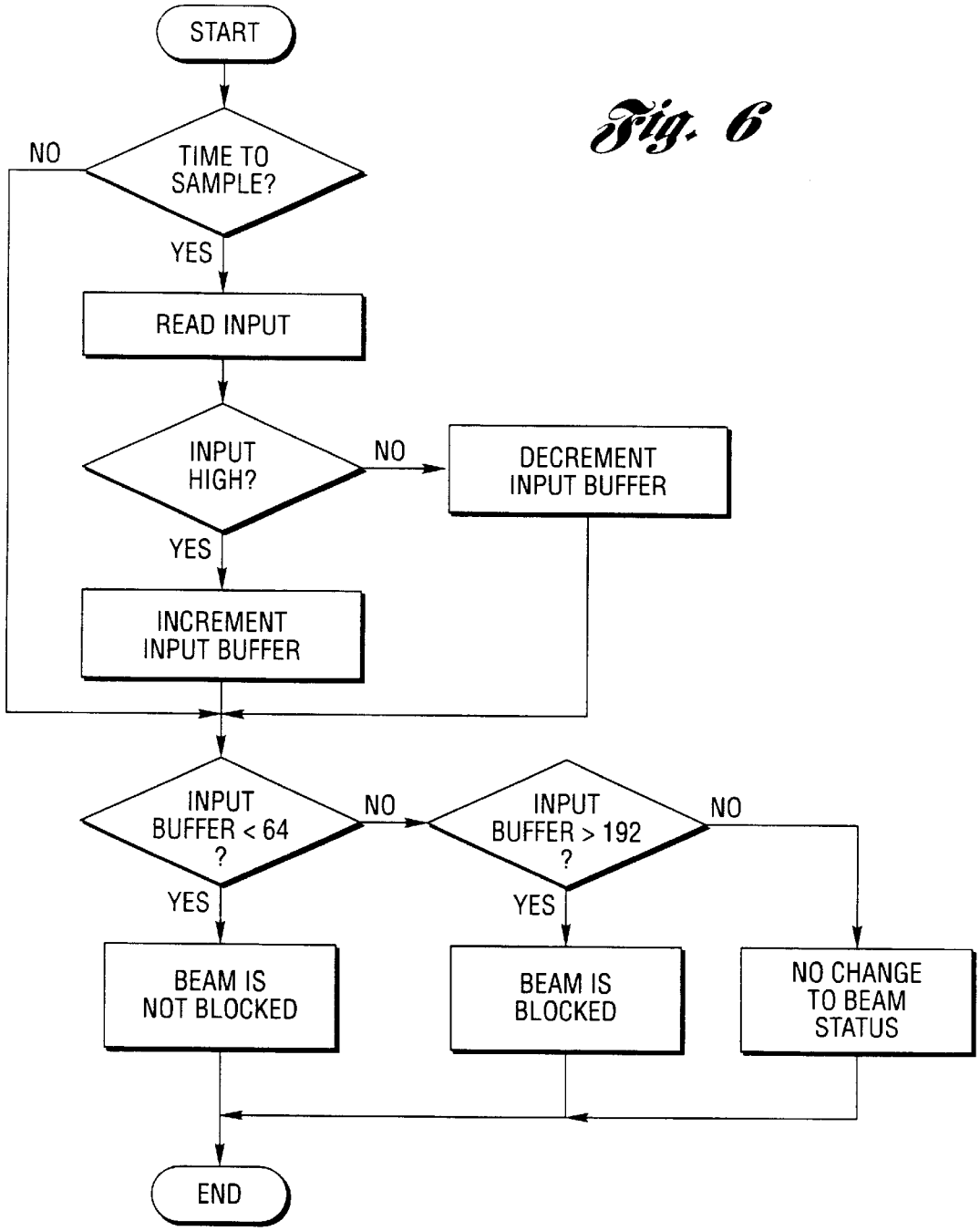
FIG. 6 is a flow diagram of a process performed by the controller of the preferred embodiment of the present invention.

FIG. 5 diagrammatically shows the input voltage to the microcontroller 70, preferably comprising a processor with internal memory, of FIG. 4 that enables the controller 70 to determine the condition of the optical coupling between the IR emitter 66 and the IR detector 68. Although other voltage ranges or other parameters, may be monitored for adaptive control without departing from the invention. In the preferred embodiment voltages between 0.0 and 0.2 indicate a system fault. Voltages between 0.2 and 0.4 indicate blockage by ice. Voltages between 0.4 and 1.0 indicate diagnostic representation for need of preventative maintenance to clean lenses. Voltages between 1.0 and 2.8 indicate dirty lenses that still function normally. Voltages between 2.8 and 3.2 indicate possible fog or lens contamination that still allows normal function. Voltages between 3.2 and 4.0 indicate normal system operation with clean lenses. Voltages above 4.0 indicate system fault.

It is particularly important to realize that the adaptive optoelectronic circuitry herein described enables significantly improved reliability and performance versus fixed optoelectronic circuitry operation, approximately 10 times the operating time between required lens cleanings. Furthermore, this technology is amenable to sensing numerous ice machine characteristics including falling ice pieces during ice harvesting operations and ice bin full condition, water reservoir low float sensor level condition, and water reservoir high float sensor level condition.

An alternative preferred implementation of optoelectronic emitter detector interrupter mode of sensing reservoir water high and low float levels-utilizes fixed emitter drive circuitry and fixed detector amplification circuitry in cooperation with software algorithms that provide running average samples of digital readings to adapt average digital output signal duty cycles at which high and low water levels are ascertained from initial default values of 50%.

Mineral fouling of optoemitters and optodetectors is slow for optic components utilized on water reservoir float level sensing applications relative to fouling rates of similar components in the high splash and fog area of the ice chute. As such, the determining factor for required ice machine service to clean optic components is the length of operation time until the ice chute/binfull optosensor optics become fouled beyond function due to mineral deposits. Furthermore, optodetector blinding from ambient light does not interfere with the environment of this sensing application as it might in the environment of the ice chute. When these two most significant fault modes are unapplicable, emitters may be simply driven hard and detectors simply highly amplified to give reliable digital signal output levels for logical input by the microcontroller.

Various bobbing actions of the opto target window integral with the water reservoir float changes the digital output of the optodetector sensor based upon immediate conditions of water flow characteristics within the reservoir. Very precise water reservoir levels, ice piece sizes, and ice production rates are achieved by adaptively determining the average float levels by software sampling and averaging techniques. The bobbing water level sensing float assembly causes the sensed signal to repeatedly change from logic low to logic high to logic low, etc. Running averages of periodic samples of the logic level provide a software filtered signal value. For example, the stepped input filter response for average value of a change from 00 to FF hexadecimal, reflecting a full range change of movement of the float, may be sufficient if computed in approximately 4 seconds. Initial default values of the average filtered logical values for high and low water levels are a 50% duty cycle signal at each of the optodetectors. Preferably, a high level detector and a low level detector, respectively. In other words, when the resultant sampled and averaged water level signal of the high sensor reaches 50% of a maximum FF hexadecimal scale, the water level is determined to be high. Similarly, when the resultant sampled and averaged water level signal of the low sensor reaches 50% of a maximum FF hexadecimal scale, the water level is determined to be low.

When non-adjustable mechanical configurations of the water level float must work in cooperation with the high and low optoelectronic detectors in a sensor 46, it is possible that the respective resultant sampled and averaged signals from full high and/or full low water reservoir conditions might not exceed 50%. For example, if the overflow standpipe drains the filling water at a level that disallows the bobbing float opto signal to average >50% at high water level, a fixed software system would signal a fault. The controller 70 includes software to monitor the rate of increase of the running average of sampled signals from the high optosensor during water reservoir filling and adaptively modifies the 50% threshold to a lower threshold as required to consistently sample a precise high averaged water level signal that is reliably sensed.

Similar adaptive software enables the controller 70 to monitor the rate of decrease of the running average of sampled signals from the low optosensor during water reservoir lowering and adaptively modifies the 50% threshold to an appropriate threshold consistent with precise sampling of a low water level that is reliably sensed. The opto window target moving with the float can use either opto blockage or opto transmission as its signal representing the designated high water level sensing level or the designated low water level sensing level. The opto emitter and detector pair sensing water reservoir high level are located below the pair for sensing water reservoir low level—both pairs looking through the same moveable window.

As described above, adaptive optoelectronic sensing techniques provide relatively long operation time until the optic components foul and cause a fault condition necessitating service to clean the optics. Alternative technologies for sensing ice utilize sonic, ultrasonic, and/or vibration technologies to sense falling and/or standing ice pieces. Such technologies are fully described by commonly owned U.S. Pat. No. 5,706,660 Method and System For Automatically Controlling a Solid Product Delivery Mechanism and U.S. Pat. No. 5,922,030 Method and System For Controlling a Solid Product Release Mechanism, incorporated by reference.

Certain types of commercial ice making machines utilize ice molds that harvest the ice as a single large sheet that breaks up into individual pieces after dropping from the ice mold. This ice mold configuration lends itself to an alternative and preferred simple and low cost sensing of falling ice by use of a swinging panel with an attached magnet sensed by a reed switch. When the ice sheet is harvested, it hits the swinging panel causing it to temporarily move out of its stable hanging position. The attached magnet moves away from a proximal reed switch causing the reed switch to change state, the change being sensed by the controller that determines that the ice sheet has fallen to complete the ice harvest. In this sensing application combined costs of a permanent magnet and a reed switch are a very low cost sensing alternative with very high life reliability.

Preferably, the controller 70 may be set up so that total ice produced per cycle is based upon a number of times that the water reservoir goes from a sensed condition of high to low. An alternative technology that can be used alone and/or in cooperation with water reservoir level sensing is use of capacitive electric-field dielectric proximity sensing of ice thickness on the ice molds. Simply sensing the total amount of water that is converted to ice does not sense the abnormal condition whereby a single ice piece does not fall during the harvest operation and subsequent ice buildup causes ice to bridge over the divide between adjacent ice molds. When ice formation bridges over multiple individual ice molds, harvesting thereof becomes more difficult and requires more time than during normal operation. Accumulated ice formation from several ice making operations poses the potential for mechanical damage to closely proximal ice molds due to forces caused by expanding ice. To preclude such potential for machine damage, a longer harvest cycle is performed every so many ice harvest cycles and/or every so many ice making minutes in order to thoroughly remove produced ice.

An alternative means to sense actual ice production on the molds utilizes technologies based upon capacitive electric-field dielectric proximity sensing areas. Such technologies are commonly owned and fully described in U.S. Pat. No. 4,731,548 Touch Control Switch Circuit, U.S. Pat. No. 4,758,735 DC Touch Control Switch Circuit, U.S. Pat. No. 4,831,279 Capacity Responsive Control, U.S. Pat. No. 5,087,825 Capacity Responsive Keyboard, and U.S. Pat. No. 5,796,183 Capacitive Responsive Electronic Switching Circuit incorporated by reference. Capacitive proximity sensing determines actual thickness of ice over at least one individual ice mold by sensing proximity to capacitive sensing elements via electric fields and dielectric properties. Ice thickness is alternatively determined by contact with vibrating probes such that the vibration frequency and/or amplitude changes as ice growth encompasses said probes.

In certain field applications, ice machines are placed in such location and position that when an ice user opens the ice door, sufficient ambient IR floods that ice bin that the binfull and ice falling sensors are blinded by saturating IR noise. Experience has shown that operators sometimes leave the ice bin doors open, causing extended periods of optosensor blinding. The typical previous fault mode causes the ice machine to stop ice production, but the machine does not know whether the optoelectronic sensing system is simply temporarily blinded or whether there is a circuit fault. The previous and less preferred alternative is to discontinue ice making, time out, and shut down operation until service is called. In the present invention, addition of a switch on the ice machine harvest door to signal its closed status to the controller provides an important input to let the controller 70 know that optosensor noise blinding is due to the door being open and thus the proper response is to simply discontinue ice making operation and wait until the ice door is shut again. The ice door switch saves an unnecessary shutdown and service call caused by ice user carelessness.

Numerous types of system component damage can be caused by operation under high and/or low line voltage. Motors, particularly compressor, pump, and fan motors, are damaged by either high or low line voltage. Most components are specified for operation under a limited range of operating voltages. For this reason, the controller 70 monitors the supply line voltage and actively controls an orderly shutdown, and sets an indication recording appropriate fault code data including a time date, under conditions of insufficient or excessive line voltage.

Ice tends to have significantly lower solid state solubility for minerals than does liquid water. For this reason, the ice making operation tends to concentrate minerals in the recirculating water of the reservoir. Depending upon accumulations of soluble and insoluble minerals, the controller is preferably set up is set to purge the water reservoir every so many ice making cycles, whether it needs it or not. In some cases the number of ice making cycles between purging may be too often and in other cases it may be insufficient and result in dirty ice, and faster mineral deposits onto components of the water system. Excessive mineral deposits is a typical cause of ice making system inefficiency that previously often resulted in automatic shutdown for a service call.

To insure that dissolved minerals and mineral solids in the water circulating system are not allowed to become undesirably excessive, several sensing technologies including turbidity, electroconductivity, and capacitive dielectric enable signaling the controller to perform a water purge cycle more frequently than some set default number of cycles. Such technologies are commonly owned and fully described in U.S. Pat. No. 5,442,435 Fluid Composition Sensor Using Reflected Light Monitoring and U.S. Pat. No. 5,828,458 Turbidity Sensor, and are incorporated by reference. Sensing of dielectric properties of the flowing water is based upon the technology of high frequency AC capacitive dielectric sensing of water quality, similar to U.S. patents referenced above for proximity sensing, although the capacitive sensing electrodes have a thin passivating insulation top coating applied and the electronic switchpoint sensitivity is adjusted to an empirically-determined level between that produced by pure water and that produced by excessively contaminated water. Alternatively, the electroconductivity of water is sensed by known electronic techniques and compared with an empirically determined setpoint to signal the need for a water reservoir purge cycle. Note that the setpoints for determination of the necessity of a water purge cycle must be adaptive because in some circumstances the supply water quality will be poor, but ice must be made nonetheless. Fault diagnostics can indicate the presence of excessive dissolved minerals and/or undissolved minerals in the supply water. Excessive undissolved minerals in the supply water suggests the addition of a fine particulate filter to enable more reliable long term operation of the ice machine with fewer service cleanings.

The change of communications hardware to standardized RS-485 full/half duplex is preferred for faster transfer of data into and out of the controller, although other formats may also be used, for example RS-422. This reduces the functional test time during production evaluations and improves data logging and diagnostic troubleshooting. Two RJ11 jacks as an external interface enables circuitry to be configured to communicate on a low cost RS-485 network for Intelligent Kitchen applications, presently under industry development.

Figure 3A:
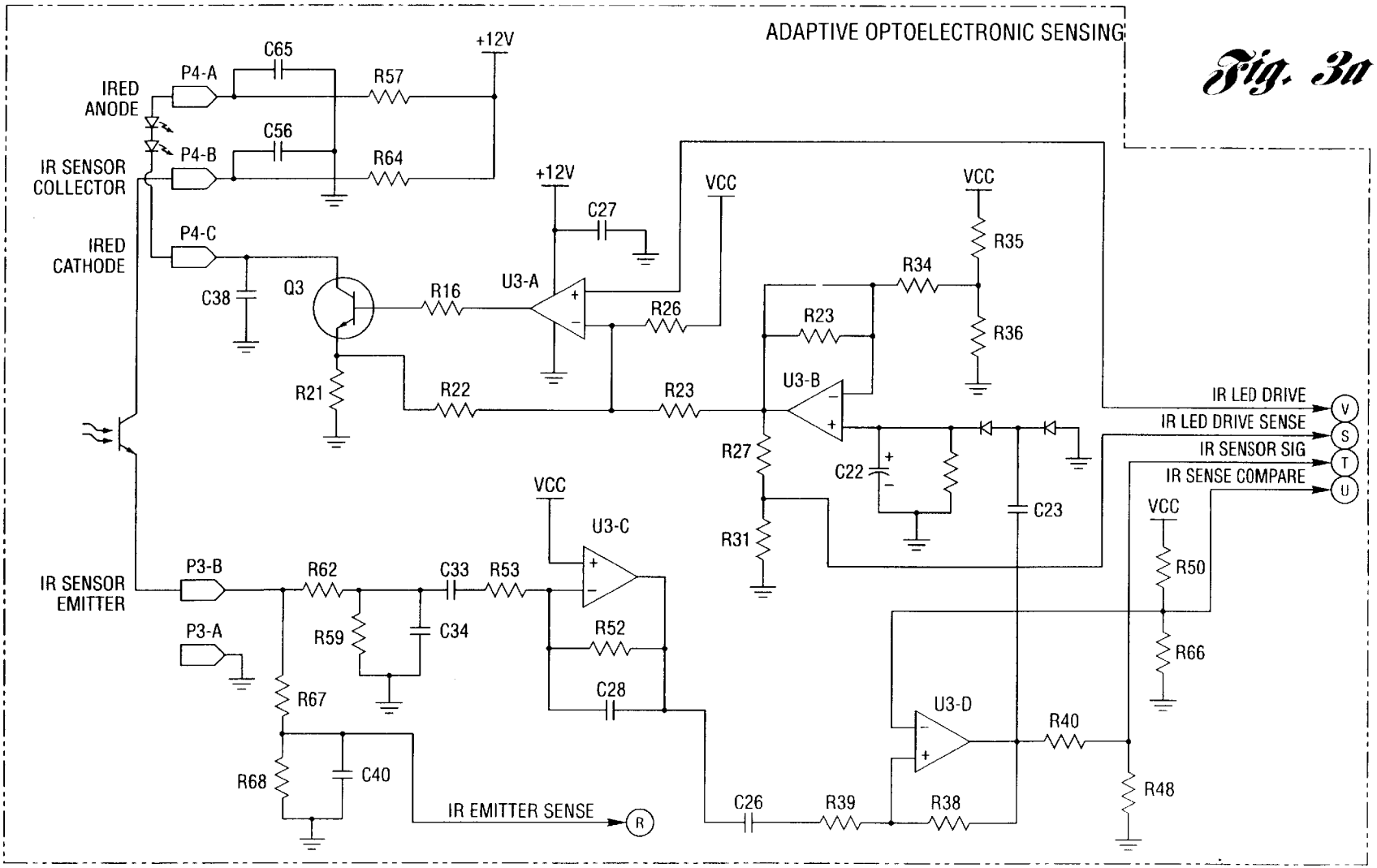
FIG. 3 is an electronic circuit schematic diagram particularly showing an alternative preferred means of implementing optoelectronic sensing of ice pieces.
Figure 3B:
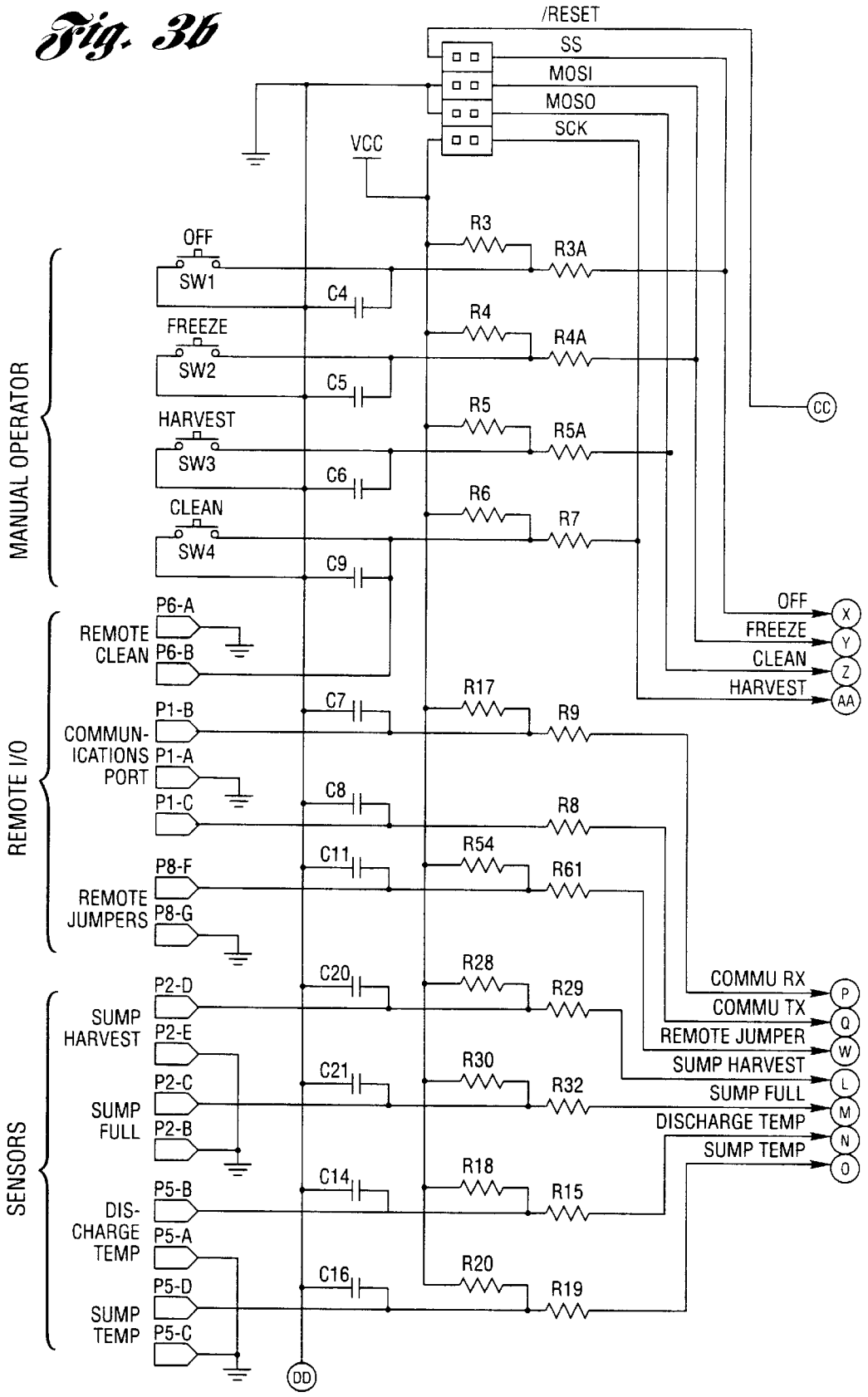
Figure 3C:
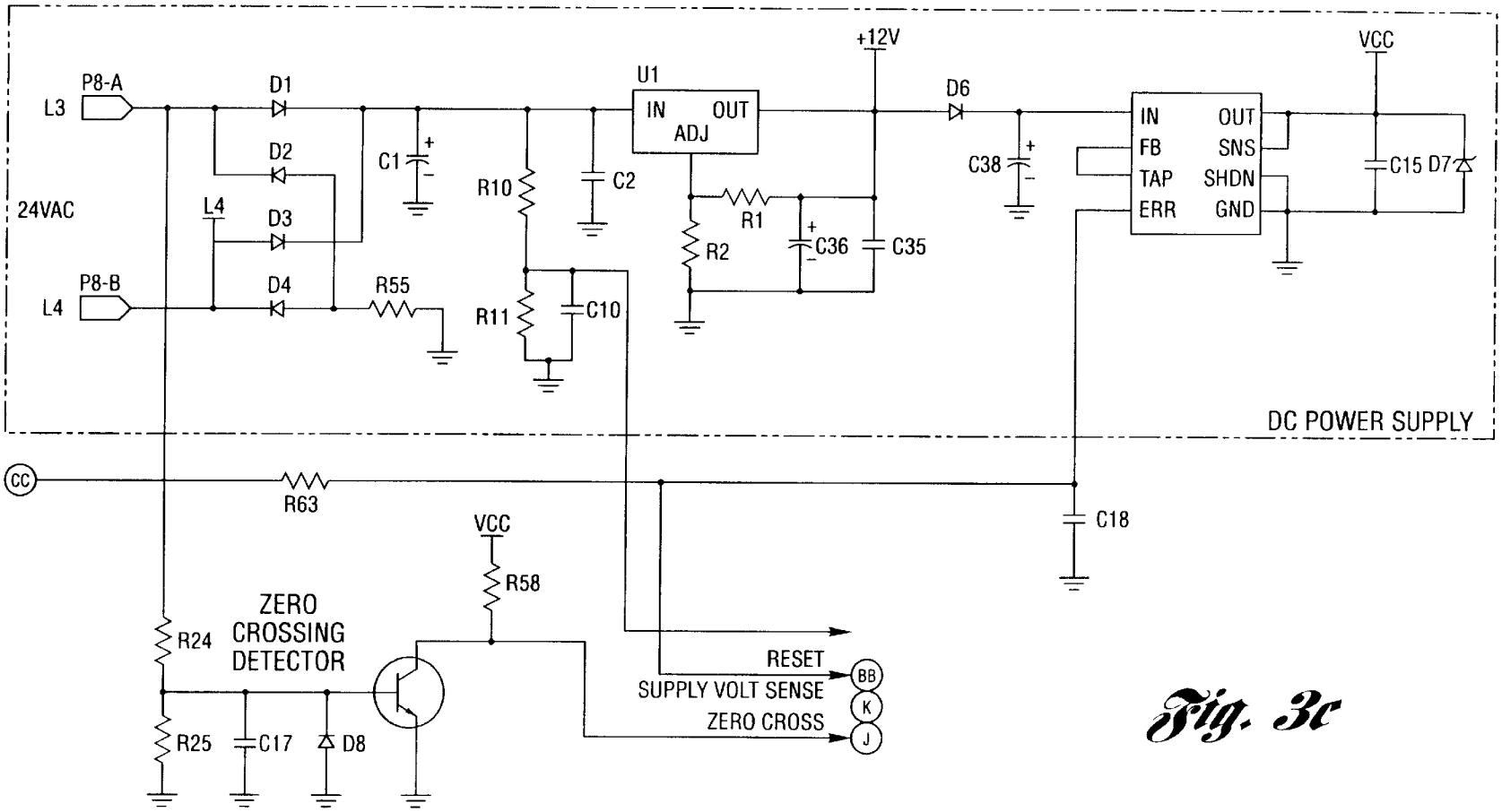
Figure 3B:
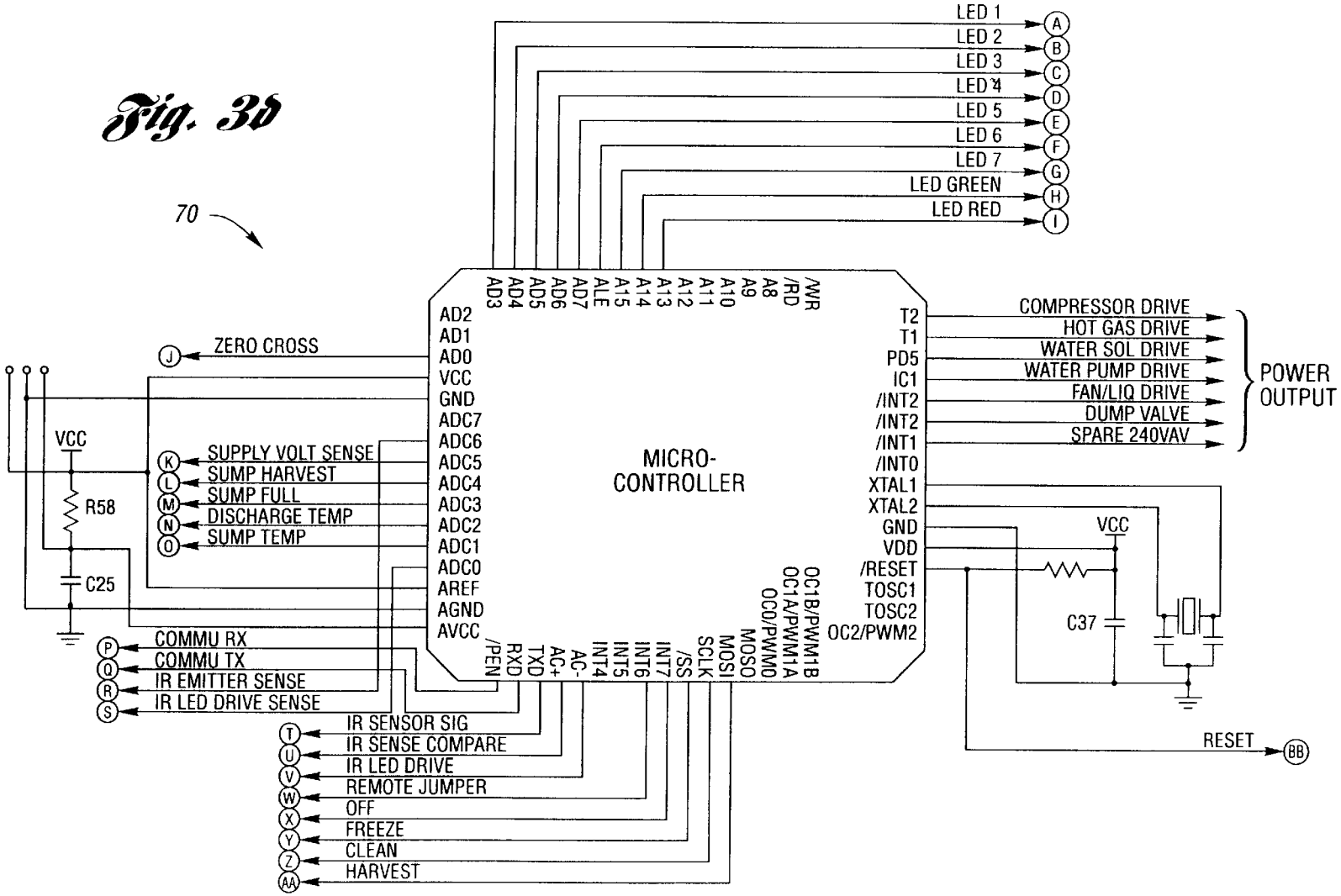
Figure 3E:
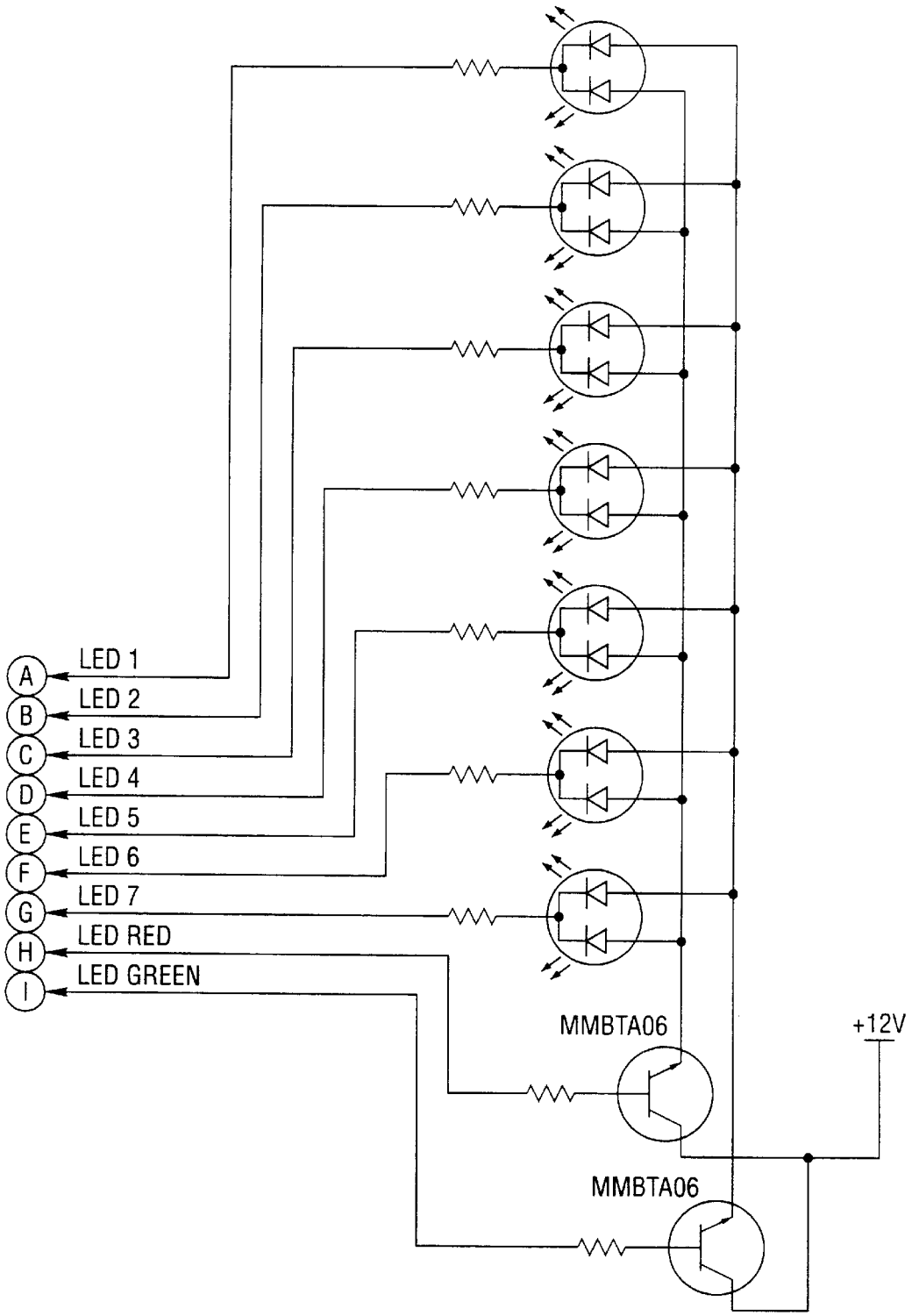

An alternative embodiment enables remote diagnostic communications of automatic ice making machines by incorporation of such automatic and/or manual communication means as telephony and/or electromagnetic radio frequency interface. Such telephone and/or radio communications may be self-initiated by modem, radio communicator, hardwired means or the like, coupled to communications ports as shown in FIG. 2*a* or FIG. 3*b*, to communicate specific abnormal fault conditions and/or to communicate regular operation and fault status in order to clear ice machine controller memories in preparation for continued monitoring. Communication may alternatively be initiated, not by the ice-making machine, but from another site at arbitrary times or at regular intervals, as per polling operation. Such remote communication can be unidirectional or bidirectional by one or more communication means.

Additional purposes for remote communication include operation parameter upgrades and programming revisions. This further enables remote machines to perform in the capacity as engineering research tools toward development of improved operational parameters and algorithms that may be loaded into the ice making system controller.

The most significant ice machine electrical load is that of the refrigeration compressor. The most significant electrical load of the compressor is during startup. Typically, startup current for motors is in the range of approximately 4½ to 6 times normal operating current. The high starting current decreases significantly as the motor comes up to speed. The time that the compressor takes to come up to full operating speed is dependent upon the amount of back pressure at the compressor outlet. High pressure loads cause the compressor to come up to speed in a slower manner. The high inrush and starting currents during starting of a compressor under load cause additional heating and reduced life of the motor, mechanical switches, contactor relays, and/or solid state switches. Additionally, the high inrush and starting currents tend to drop the supply voltage to all other loads on the same supply line. This voltage dip can cause dropout of discharge lamps, dimming of incandescent lamps, flickering of fluorescent lamps, speed changes in other motors, distortion of cathode ray tube picture dimensions, and other undesirable effects. Further addition of a control valve to reduce back pressure at compressor prior to and during compressor motor startup eases starting current transients and thereby increases compressor motor control relay contact life. The controller 70 easily implements this compressor startup feature by monitoring refrigeration-related parameters and thereby controls a refrigeration pressure release valve or a refrigerant recirculation valve.

The compressor motor start coil supplies the majority of the starting current for a time duration until the motor is running sufficiently fast to discontinue energization of the start coil. This switching of this particularly high system electrical load is a burden on a mechanical relay contactor which has characteristic bouncing of contacts upon closing. Contact bouncing, high currents and inductive load characteristics lead to shorter life reliability and multiple electrical transients on the supply line. To promote longer compressor life reliability, an appropriate sized solid state motor start relay is preferred. For AC motor applications, a solid state relay with controlled startup turn-on switching at peak line voltage preferably reduces the potential for huge current transients associated with complete magnetic saturation of motor ferromagnetic components. By switching power to the starting coil at a peak line voltage, the initial half-cycle integration of volt-seconds of the switched waveform produces a relative amount of motor magnetic flux that is less than saturation, dependent upon motor design and residual magnetic induction. Such huge full saturation current transients, on the order of 100 to 150 times normal peak operating current, additionally have detrimental effects on the life of the motor, life of associated power switching components, and sensitive electrical devices sharing the same power supply line. Solid state switching also favorably eliminates the contact bouncing and the multiple associated line transients associated with electromechanical switching means and provides opportunity to carefully control energization and deenergization relative to supply line waveforms.

Software control limits how often the compressor motor is allowed to start and the duration of start current for the purpose of limiting the significant heat produced and resultant high temperatures. Ice machine control presently overrides operator attempts to repeatedly start the compressor motor too frequently. To provide a failsafe hardware system that disallows excessive motor heating from an abnormal circumstance, an alternative embodiment of the invention adds a positive temperature coefficient (PTC) resistor in series with the start coil of the compressor motor as hardware that will automatically remove high power energization levels from the start coil when the coil and/or the PTC resistor reach a specified temperature. This protects the motor start coil from being energized when it exceeds a particular temperature. Typically, the PTC resistor may be in thermal contact with the start coil so that its resistance will increase in cooperation with the motor start coil. A PTC resistor for motor protection application will increase its resistance approximately 100 fold over a predetermined range of temperature to electrically limit and protect its thermally associated series power device.

A dump valve module has been a separate assembly that interfaces with the ice machine controller only as a time responsive switch to the drive signal originally created by a drive circuit generating a signal for hot gas valve actuation output from the controller. Functional performance enhancement is realized by incorporation of the dump valve module control hardware and dump valve control functions integral with the ice machine controller module. This integration of hardware, software, and performance monitoring results in a full range of timing and control performance improvements and very significant cost savings. Such integration further lowers system hardware and assembly costs and improves ice machine system reliability by elimination of the separate dump valve module, associated wiring, associated electrical connectors, and manufacturing assembly labor. Furthermore, direct control of the dump valve by the ice machine controller module 70 reduces water waste by more accurate system control in cooperation with all other ice machine controller timing and functions.

Refined control capability is enabled by replacement of electromechanical with solid state switching means for motor controls. Solid state motor control allows the controller to operate the motors via phase control switching for variable speed and variable power. Motors for which specific benefit results from speed control include compressor motor, condenser fan motor, and water circulation pump motor. Benefits of solid state switching phase control for motors include motor speed control, motor power control, elimination of electromechanical relay contact bounce, and new capabilities as specific system operation control modes. Such specific operation modes include quiet operation by running compressor and fans at lower speed, maximum ice production by running compressor and fans at maximum speed, most efficient ice production by running motors at speeds empirically determined to produce most amount of ice per energy consumed under ambient conditions, clear ice production by running compressor at lower speed and fans and water pump at high speed, and additional unique control modes enabled by specific speed control for each of the three system motors.

A new microcontroller utilizing RISC (reduced instruction set controller) architecture with flash ROM (read only memory) and internal EEPROM (electrically erasable programmable read only memory) provides for expanded controller capabilities. The RISC architecture allows for fast compact code that supports software algorithms used to process sensor input signals, control, communications, and advanced diagnostics. The flash ROM allows production and/or field programmable updates to software to reduce warranty and obsolescence costs incurred by the customer. The internal EEPROM reduces hardware cost and improves reliability by integrating the memory into the microcontroller.

Proliferation of significant numbers and ranges of types, sizes, and possible ambient operation conditions for ice-making machines has resulted in numerous control algorithms with specific programmed operation parameters resulting in excessive machine service calls. The preferred embodiment provides a solution that enables semi-customized operation of each commercial ice machine regardless of its environmental location. A change of the central processing unit to flash ROM with internal EEPROM permits improved diagnostics, reduces warranty costs for service calls, permits firmware upgrading, eliminates an external EEPROM (integrated circuit), and improves overall performance and reliability.

When a service technician sets up a commercial ice machine at a location, a "smart card" memory, about the size of a large postage stamp, containing typically 4 M byte of memory functions as a universal field program loader for the ice machine controller setup. Many individual ice machine programs, on the order of 8K byte each are easily stored on a single 4 M byte "smart card" memory. Should any subsequent field service be necessary, the technician can simply and easily use a "smart card" memory for various purposes including as a universal controller, for troubleshooting and diagnostics of operation fault codes, for evaluation of operation history, and for operating parameter field upgrades.

Controllers have been typically programmed at the ice machine manufacturer with operating parameters specific to the ice machine into which it is installed. Since service centers have neither the equipment nor the expertise to program the controllers, they have kept on hand one controller for each ice machine model. A small printed circuit board (PCB) with EEPROM chip easily olds the parameters for a particular model of ice machine. When a controller is replaced in the field, the PCB "key" is plugged into the controller at which time the controller extracts the operating parameters from the key and programs them into its internal EEPROM. This allows service centers to stock only one generic controller along with a number of inexpensive characterization keys, one for each ice machine model. These keys are easily distributed to service centers as operating parameter changes for specific ice machine models become required. Furthermore, such keys enable ice machine parameters to be customized for more optimal ice machine performance in any specific environmental application.

Compact flash ROM card technology is currently in use with digital cameras. The flash memory chip is built into a low cost package with a large memory capacity. This card, for a relatively low cost of at approximately $8, can hold not only the operating parameters for all ice machines, but entire controller 70 software versions as well. When interfaced to the controller in a similar fashion as the EEPROM key, the controller is capable of updating its internal operating parameters as well as its entire source code. This provides a highly effective means of achieving the field upgradable controller independent of the microcontroller 70 selected.

The principal method of control turns the water circulation on immediately with energizing the compressor motor. For several reasons it is alternatively preferred to delay circulation of the water until after the ice molds are prechilled. One reason is that prechilled molds will initiate ice seeding immediately upon first circulation, thus eliminating the necessity for an ice seeding operation after the circulating water cools to a near-freezing temperature. A second reason is for diagnostics and control monitoring purposes—the rate at which reservoir water cools provides an indication of the overall performance of the ice making system. For consistent production of ice pieces, the rate of water temperature cooling should not occur too fast or too slowly. In order to improve the precision of adaptive diagnostics for rate of water temperature cooling, it is very important to operate each cycle in a very consistent manner, particularly in beginning water flow with the compressor operating under steady state and the ice molds prechilled. Such prechilling is enabled by allowing a programmable time delay after the compressor is energized before the water circulating pump is energized.

To utilize fewer water reservoir components in more ice making machine configurations, the control algorithm refills the reservoir various times and various ways during the ice making operation. For example, machines with small molds or with only a few molds, may only need to fill the reservoir one time.

For incrementally more ice making capacity, the reservoir may be refilled, or "topped off" immediately after initiating water circulating. Alternatively, for slightly more ice mold capacity, the reservoir may be refilled one time only after it is sensed to reach the low level during an ice making cycle. Based upon the number of water reservoir refills from sensed low level to circulation, the total amount of water provided for conversion to ice can be precisely controlled over a wide volume range with relatively small incremental volume resolution. This method of water volume control is amenable for use with a wide range of configurations of reservoir size, ice mold types ice mold sizes, and numbers of ice molds.

A programmable and adaptive water reservoir temperature setting TSI may be adaptively set, the setting TSI being based upon the temperature below which the ice seeding operation is performed. This temperature setting TSI is adapted based upon operation diagnostics of ice making and ice harvesting to reduce the possibility of occurrence of ice slush formation. To reduce the potential for ice slush formation, makeup water is added to the water reservoir to raise its temperature. To increase the probability that ice seeding will occur at all ice mold sites, a lower water reservoir temperature at the time of ice seeding is desired. The actual water reservoir temperature at the initiation of ice seeding is a tradeoff to optimize reliability versus production.

A programmable and adaptive water reservoir temperature cooling rate setting TCI is set at a cooling rate above which rate, the controller commands warmer makeup water to be added to the reservoir to avoid ice slush formation. As with the programmable ice seeding temperature, a high rate of reservoir water cooling is an indication of the possibility of undesirable ice slush formation for which the response is to add some warmer makeup water. If the reservoir water temperature lowers too slowly, it can indicate that the refrigerant system is low on capacity or that there is residual ice on the ice molds from a prior operation. The controller 70 generates a response to ice on molds by commanding the machine to run the ice harvest for an extended time to remove possible undesirable accumulation of ice from multiple ice making cycles.

A programmable and adaptive time duration setting THL is set at a time duration for which the water reservoir level is to go from high to low. If the controller is signaled that THL is exceeded, the controller commands the machine to run the ice harvest for an extended time to remove undesirable accumulation of ice from multiple ice making cycles. The controller 70 will learn whether such an extended harvest cycle reduces the time for the water reservoir to go from high to low on subsequent cycles. If the time does go down, the controller will command that a longer time will be set for harvest cycle If the time does not go down, the controller signals that the system is losing ice making capacity for some reason, for example, such as dirty fins in the condensor heat exchanger and/or loss of refrigerant.

A programmable and adaptive time duration setting THI is set for the time duration in which the falling ice pieces will be sensed by the sensors during the harvest operation. Longer than anticipated time THI the controller may determine that the prior harvest cycle was incomplete allowing the present ice making cycle to build up onto left over ice from the previous cycle. Since the measured time to last falling ice piece should be relatively consistent. The controller 70 responds to increasing harvest times and/or decreasing harvest times as monitored trends can be used as diagnostics. In a preferred response after a predetermined but suitable number of harvest cycles, an unusually long ice harvest is commanded by the controller to be performed to be assured of harvesting all individual ice pieces from all molds. Since accumulation of ice thickness without harvesting poses the possibility of ice mold damage, ice harvesting should be performed completely, yet efficiently.

An over/under dual ice machine control method and configuration may share the ice harvest/ice binfull sensing capacity of a single set of sensors. The controller will command both machines to be stopped from production when a binfull is sensed. In a stacked configuration of multiple ice makers, the terminals labeled "second system remote bin" permit coupling so that the second (top) maker, remote from the collection bin cooperates. The bottom unit's transmit signal is coupled to the top unit's receive input and the top unit's transmit is attached to the bottom unit's received terminal so that the top unit knows not to make ice at a bottom bin full condition, the bottom unit will know that the top unit is harvesting.

A side-by-side dual ice machine control method and configuration includes controller responses to signals communicating the rates of ice making cycles among two adjacent machines and coordinates ice making cycles of both machines to the rate of the slower machine. Due to numerous factors, nominally identical ice making machines may develop a noticeable difference in ice production over time. To preclude typical customer service complaints about dissimilar production rates from ostensibly identical machines, the controller commands the faster of the two machines to be slowed to the ice making cycle rate of the slower machine.

A programmable and adaptive time duration setting TOW is set for discontinuing water circulation during the ice seeding operation. Longer times for setting TOW promote more assured ice seeding, and shorter times promote quicker ice making cycles. The controller monitors and controls other factors such as the temperature at which ice seeding occurs, the rate of water temperature cooling, and the time to last ice piece harvested, that can be used as an interactive part in the algorithm that determines the adaptive time duration for ice seeding. Faster rates of water temperature cooling lead to shorter ice seeding times. The tradeoff is production rate versus reliable machine performance.

The controller 70 also determines when to command a purge valve, which is preferred over simple use of an overflow standpipe for removal of dissolved and undissolved minerals from the water reservoir. Although an overflow reservoir will remove dissolved minerals at a relatively slow rate, a purge valve effectively removes dissolved minerals, undissolved minerals, and particles of sediment in a quick and effective manner. The controller may combine circulating pump actuation with a controller purge valve actuation under low pressure to aggressively purge everything drawn from the water reservoir. The net result is more effective purging using less water and less time.

The controller 70 includes diagnostics software to monitor and record operating characteristics of the system, particularly unusual conditions related to faults. Diagnostics capabilities of the improved controller system are—greatly expanded with the improved microcontroller, expanded memory, reprogrammability, and communication interface improvements. In the event of a failure in the system, the memory incorporated with the controller will contain sequential and historical operating information to assist a service technician in determining and correcting the root cause failure in the system. Previous fault diagnostics response algorithms have responded to certain faults by shutting down the ice machine, indicating for need for service. One condition causing this prior response was ambient light noise getting into the ice bin because of an ice user leaving the ice bin door open, causing saturation of optoelectronic detectors. Another condition causing this prior response was a temporary shutoff of the ice machine water supply. Earlier control algorithms were unforgiving of these types of conditions which are more prevalent than originally anticipated. Improvements in sensors, expanded memory capabilities, and more forgiving control algorithms enable the ice machine controller to log faults, operation history, and diagnostics while continuing to attempt normal operation cycles to overcome potential shutdown conditions. For example, returning the water supply to the ice machine enables the controller 70 to sense and respond the condition change and command the machine to continue with normal operation, and canceling the logical flags or indications leading up to a possible communicated indicator for a service call.

Changes of the limited numbers of LEDs (light emitting diodes) from dedicated single color indicators to tri-color LEDs enables display of a even greater number of operation status conditions to improve diagnostics. Furthermore, additional combinations of indications enables new types of early warnings for system maintenance, for example a pending need to clean the optics.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A controller system and apparatus for at least one fully automatic electronic-controlled ice making machine comprising:

a microprocessor;

a controller memory linked for communication with said microprocessor;

at least one diagnostics program in one of said memory and said microprocessor for determining a response to a plurality of inputs;

a communication interface;

a sensor detecting at least one water reservoir temperature and generating a first input to said processor;

a sensor detecting an amount of ice on ice molds and generating a second input to said processor;

a sensor detecting harvested ice and generating a third input to said microprocessor;

a circulator for delivering water over ice making molds at a mass rate significantly greater than the mass rate of ice production, said circulator including at least one water control valve and a pump driven by a motor in said circulator;

a control for energization of said at least one water control valve in response to a first determined response from said operation diagnostics program;

a control for energization of said motors in said circulator; and a control for energization of at least one refrigerant control valve in response to at least one of said first, second and third inputs.

2. The controller system according to claim 1 wherein said microprocessor is based upon a reduced instruction set code (RISC) architecture.

3. The controller system according to claim 1 wherein said controller memory is integral within the microprocessor.

4. The controller system according to claim 1 wherein said controller memory includes flash read only memory (ROM).

5. The controller system according to claim 1 wherein said controller memory includes electrically erasable programmable read only memory (EEPROM).

6. The controller system according to claim 1 wherein said controller memory includes removable EEPROM memory.

7. The controller system according to claim 6 wherein said removable EEPROM memory is programmed for field updating system operational parameters.

8. The controller system according to claim 6 wherein said removable EEPROM memory is programmed for field updating source code.

9. The controller system according to claim 1 wherein said operation diagnostics software monitors operating conditions of the ice making machine.

10. The controller system according to claim 1 wherein said operation diagnostics software stores data relating to abnormal and/or fault conditions in controller memory.

11. The controller system of claim 10 in which said operation diagnostics software comprises stored data including information about operation history prior to and throughout fault conditions.

12. The controller system according to claim 1 wherein said operation diagnostics software stores data relating to fault and/or normal operating conditions in controller memory for purposes of system performance evaluation.

13. The controller system according to claim 1 wherein said communication interface means includes input and/or output communication via a communication interface bus.

14. The controller system of claim 13 wherein said communication interface bus further comprises an RS-485 bus in full or half-duplex communication mode.

15. The controller system of claim 13 wherein said RS-485 bus couples said controller system with a kitchen network.

16. The controller system according to claim 1 wherein said communication interface means includes RJ11 jacks.

17. The controller system according to claim 1 wherein said communication interface means includes input via at least one operator switch.

18. The controller system according to claim 1 wherein said communication interface means includes input via at least one service switch.

19. The controller system according to claim 1 wherein said communication interface means includes output via at least one panel indicator lamp.

20. The controller system of claim 19 wherein said at least one indicator lamp includes at least a plurality of indicator colors.

21. The controller system according to claim 1 wherein said sensor for the amount of ice on molds comprises at least one water level sensor of the water reservoir, and a comparator for comparing the reservoir level detected with a level corresponding to an amount of water supplied for ice production.

22. The controller system of claim 21 wherein said at least one water level sensor of the water reservoir incorporates a permanent magnet moving with a water level float, said magnet being sensed by at least one reed switch.

23. The controller system of claim 21 wherein said at least one water level sensor of the water reservoir incorporates at least one optoemitter and at least one optodetector in an optocoupled arrangement to electronically signal the optocoupling and the lack of optocoupling, for which the moving float assembly alters said optocoupling based upon the level of water in the reservoir.

24. The controller system of claim 21 wherein said microcontroller reads the erratic digital signal caused by bobbing of the float assembly on a software sampled and software filtered basis, adaptively modifying at least one digital level detection threshold value from an initial default value.

25. The controller system according to claim 1 wherein said sensor or amount of ice on molds comprises at least one sensor sensing the thickness of ice at least one location on at least one mold.

26. The controller system of claim 25 wherein said sensor detects capacitive dielectric properties of the increasing ice thickness via high frequency electric fields emanating from at least one proximal conductive electrode array in conjunction with electronic circuitry that switches output based upon a net capacitance threshold value of said conductive electrode array.

27. The controller system according to claim 1 wherein said sensor for harvested ice includes at least one optoemitter and at least one optodetector in an optocoupled arrangement to electronically signal the presence of falling and/or standing ice.

28. The controller system optoelectronic sensing technology according to claim 27 wherein the at least one of said microcontroller and/or electronic hardware adaptively modify the optoemitter drive and/or the optodetector gain and/or the electronic interface circuitry detection sensitivity threshold to compensate for variations in optocoupling.

29. The controller system according to claim 1 wherein said sensor of harvested ice comprises an emitter and a detector of vibration signals aligned within an ice chute and/or within an ice storage bin.

30. The controller system according to claim 29 wherein said sensor detecting a level of harvested ice includes at least one curtain that swings out of position.

31. The controller system of claim 30 wherein said curtain includes at least one magnet attached to and moving with said swinging curtain and at least one reed switch changing state of electrical conductivity in cooperation with proximity of said at least one permanent magnet to sense relative movement correlating to harvesting of ice.

32. The controller system according to claim 1 wherein said control of energization of motors includes at least one solid state relay.

33. The controller system of claim 32 wherein said control for energization of motors includes switching control to provide switched turn-on conduction corresponding to peak voltages of an AC power supply waveform to reduce saturation-related current surge transients associated with load magnetic saturation affects.

* * * * *